US008277020B2

(12) United States Patent
Miyamoto et al.

(10) Patent No.: US 8,277,020 B2
(45) **Date of Patent: *Oct. 2, 2012**

(54) LIQUID EJECTION METHOD AND LIQUID EJECTION APPARATUS

(75) Inventors: Toru Miyamoto, Shiojiri (JP); Hirokazu Nunokawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 250 days.

This patent is subject to a terminal disclaimer.

(21) Appl. No.: 12/756,930

(22) Filed: Apr. 8, 2010

(65) Prior Publication Data

US 2010/0194809 A1 Aug. 5, 2010

Related U.S. Application Data

(63) Continuation of application No. 12/011,124, filed on Jan. 23, 2008, now Pat. No. 7,722,152.

(30) Foreign Application Priority Data

Jan. 23, 2007 (JP) ..... 2007-012857

(51) Int. Cl.
*B41J 2/165* (2006.01)

(52) U.S. Cl. ..... 347/23; 347/35; 347/14; 347/9

(58) Field of Classification Search ..... 347/9, 5, 347/22, 23, 14, 29–35
See application file for complete search history.

(56) References Cited

U.S. PATENT DOCUMENTS

| | | | | |
|---|---|---|---|---|
| 5,903,288 | A | 5/1999 | Yamaguchi | |
| 6,779,867 | B2 | 8/2004 | Shimizu et al. | 347/23 |
| 7,407,258 | B2 | 8/2008 | Nakahara et al. | 347/35 |
| 7,431,420 | B2 | 10/2008 | Inoue | |
| 7,722,152 | B2 * | 5/2010 | Miyamoto et al. | 347/23 |
| 2006/0214979 | A1 | 9/2006 | Inoue | |
| 2006/0290739 | A1 | 12/2006 | Hatayama | |
| 2008/0186341 | A1 | 8/2008 | Hirato | 347/9 |
| 2009/0167813 | A1 | 7/2009 | Mitchell et al. | 347/23 |

FOREIGN PATENT DOCUMENTS

| | | |
|---|---|---|
| DE | 19929316 | 12/2000 |
| EP | 0 790 128 | 8/1997 |
| JP | 55-139269 | 10/1980 |
| JP | 04-361048 | 12/1992 |
| JP | 2002-240300 | 8/2002 |
| JP | 2005-103884 | 4/2005 |
| JP | 2005-335139 | 12/2005 |
| JP | 2006-205463 | 8/2006 |
| JP | 2006-334984 | 12/2006 |
| JP | 2007-001118 | 1/2007 |

* cited by examiner

*Primary Examiner* — Matthew Luu
*Assistant Examiner* — Henok Legesse
(74) *Attorney, Agent, or Firm* — DLA Piper LLP (US)

(57) ABSTRACT

A liquid ejection method includes determining, according to image data, an ejection pixel that is a pixel at which a liquid is to be ejected and a non-ejection pixel that is a pixel at which a liquid is not to be ejected; determining, according to the image data, a nozzle requiring flushing; and ejecting liquid from the nozzle requiring flushing to the non-ejection pixel adjacent to the ejection pixel, the non-ejection pixel being among pixels associated with the nozzle requiring flushing.

20 Claims, 14 Drawing Sheets

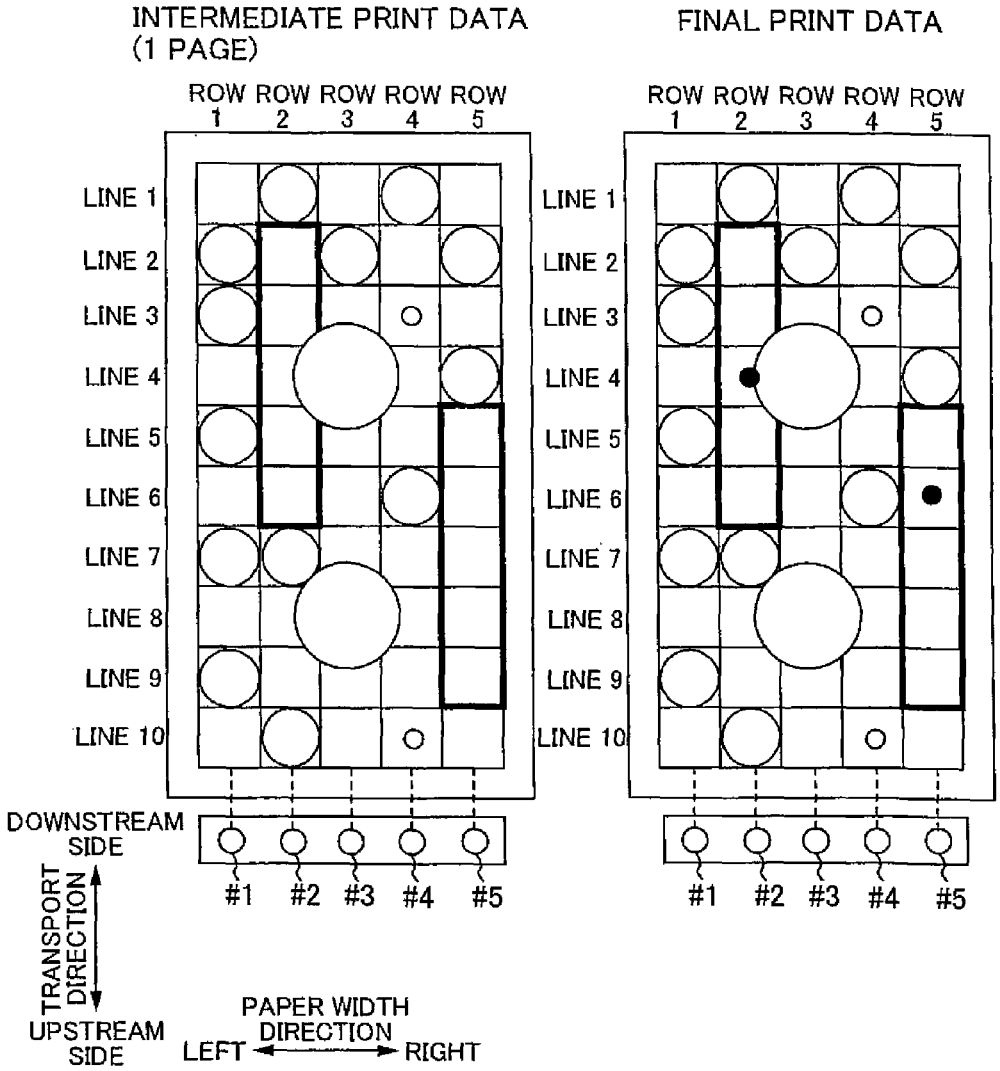
FIG. 7A
FIG. 7C
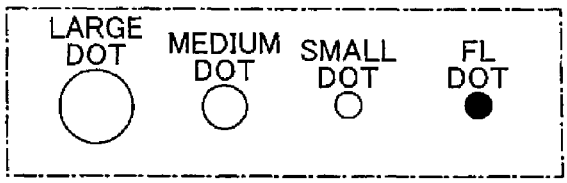
FIG. 7B

FLUSHING TABLE

| NOZZLE NUMBER #i | PAGE P | | | | | | |
|---|---|---|---|---|---|---|---|
| | 1 | 2 | 3 | 4 | 5 | 6 | |
| 1 | × | × | ○ | × | ○ | × | |
| 2 | ○ | × | × | ○ | × | ○ | ... |
| 3 | × | ○ | × | × | ○ | × | |
| ⋮ | | | | ⋮ | | | |
| 179 | × | × | ○ | × | × | ○ | ... |
| 180 | ○ | × | × | ○ | × | ○ | |

FIG. 12

LIQUID EJECTION METHOD AND LIQUID EJECTION APPARATUS

CROSS-REFERENCE TO RELATED APPLICATIONS

This application is a continuation of application Ser. No. 12/011,124, filed on Jan. 23, 2008, the entire contents of which are incorporated herein by reference. The present application also claims priority upon Japanese Patent Application No. 2007-012857 filed on Jan. 23, 2007, the entire contents of which are incorporated herein by reference.

BACKGROUND

1. Technical Field

The present invention relates to liquid ejection methods and liquid ejection apparatuses.

2. Related Art

Inkjet printers are known as one example of liquid ejection apparatuses that carry out printing by ejecting ink from nozzles onto various media such as paper, cloth, and film. Among inkjet printers there are serial printers, in which an image is accomplished while nozzles (a head) move in a direction intersecting a transport direction of a medium, and line head printers, which have a nozzle row (a head) of a length of a width of the medium and in which an image is accomplished by transporting only the medium without moving the head (JP-A-2002-240300).

In this regard, in order to prevent thickening of ink in the nozzle vicinity, generally an operation (flushing) is carried out in which ink is caused to be ejected without any relation to an image to be printed. With serial printers, the head is small and movable, and therefore an ink collecting container can be provided outside the print area for the ink used in flushing. On the other hand, with line head printers, the head is large and a new contrivance is required to collect the ink used in flushing.

Accordingly, methods are proposed in which a wide width medium transport belt and a narrow width transport belt are used such that the head and the ink collecting container are in opposition to each other through a gap of the narrow width transport belt (JP-A-2005-103884). Printing operations are stopped undesirably when flushing is carried out. For example, in the case of the line head printer, the positioning of the transport belt may be adjusted so that the head and the ink collecting container are brought in opposition to each other between the narrow width transport belts, and in the case of the serial printer, the head may be moved outside the print area to carry out flushing. Due to this, the flushing time is lengthened such that the printing time is also lengthened undesirably.

SUMMARY

Accordingly, an advantage of some aspects of the present invention is that it is possible to shorten the flushing time during printing and the printing time.

In order to achieve the above advantage, the invention provides a liquid ejection method, including: determining, according to image data, an ejection pixel that is a pixel at which a liquid is to be ejected and a non-ejection pixel that is a pixel at which a liquid is not to be ejected; determining, according to the image data, a nozzle requiring flushing; and ejecting liquid from the nozzle requiring flushing to the non-ejection pixel adjacent to the ejection pixel, the non-ejection pixel being among pixels associated with the nozzle requiring flushing.

Features and advantages of the invention other than the above will become clear by reading the description of the present specification with reference to the accompanying drawings.

BRIEF DESCRIPTION OF THE DRAWINGS

For a more complete understanding of the invention and the advantages thereof, reference is now made to the following description taken in conjunction with the accompanying drawings, wherein FIG. 7A shows a manner of dots formed based on intermediate print data, FIG. 7B shows sizes of dots that are formed, and FIG. 7C shows a manner of dots formed based on final print data, FIG. 5B shows page 2 of an image based on intermediate print data, FIG. 12 shows a flushing table.

DESCRIPTION OF EXEMPLARY EMBODIMENTS

Figure 1:
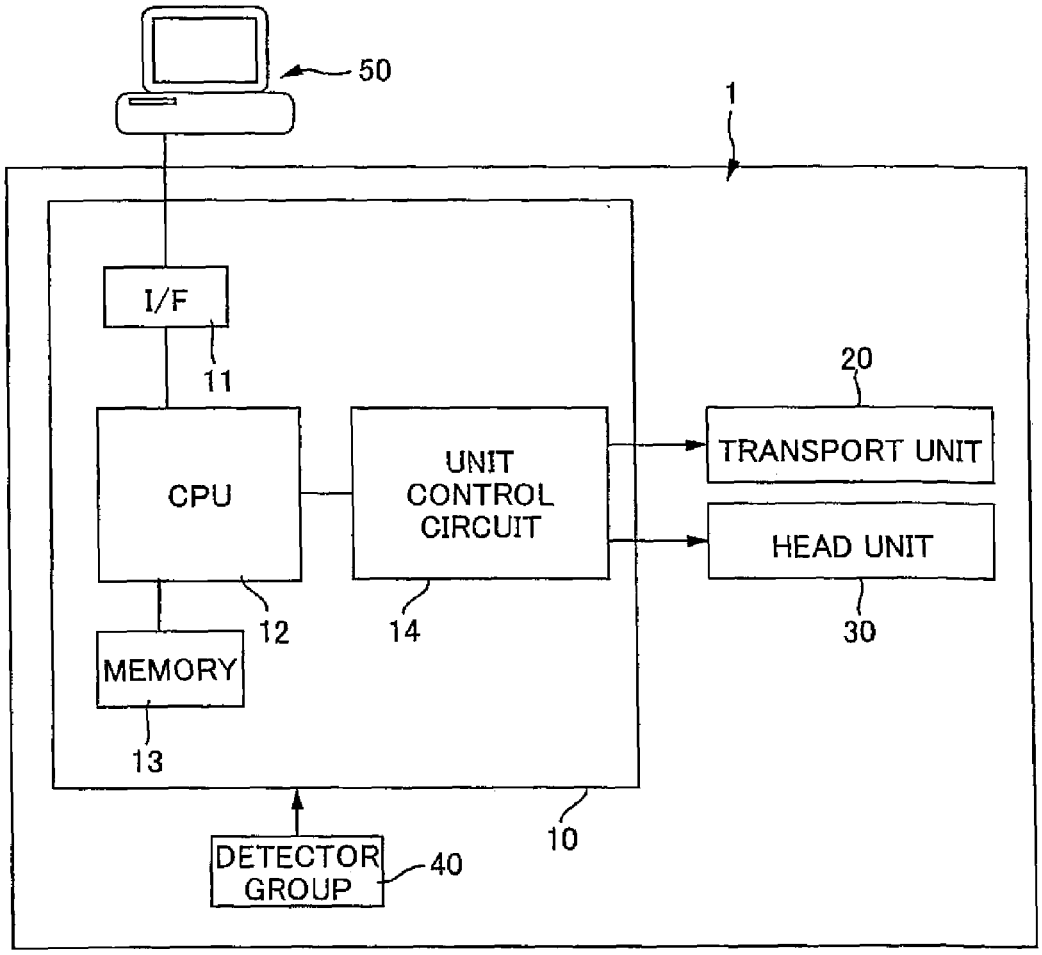
FIG. 1 is a block diagram of an overall configuration of a printer of the present embodiment.

At least the following matters will be made clear by reading the description of the present specification with reference to the accompanying drawings.

That is, a liquid ejection method can be achieved, including: determining, according to image data, an ejection pixel that is a pixel at which a liquid is to be ejected and a non-ejection pixel that is a pixel at which a liquid is not to be ejected; determining, according to the image data, a nozzle requiring flushing; and ejecting liquid from the nozzle requiring flushing to the non-ejection pixel adjacent to the ejection pixel, the non-ejection pixel being among pixels associated with the nozzle requiring flushing.

With this liquid ejection method, liquid can be ejected from nozzles requiring flushing so as to be inconspicuous in an image. Blockages are not caused in the nozzles and therefore an image having high image quality can be obtained. Furthermore, since there is no stopping of the liquid ejection operations due to flushing, the liquid ejection time can also be reduced as much as possible.

In this liquid ejection method, when dots of a plurality of sizes are to be formed by the nozzle, a largest size dot among the plurality of sizes is formed at the ejection pixel adjacent to the non-ejection pixel where the liquid is to be ejected from the nozzle requiring flushing.

With this liquid ejection method, dots having larger diameter size overlap adjacent dots more broadly or have narrower spacing with respect to adjacent dots, and liquid ejected from the nozzles requiring flushing to the non-ejection pixels are inconspicuous in the image.

In this liquid ejection method, the ejection pixel adjacent to the non-ejection pixel where the liquid is to be ejected from the nozzle requiring flushing is associated with a nozzle other than the nozzle requiring flushing.

With this liquid ejection method, liquid can be ejected by nozzles requiring flushing so as to be inconspicuous in an image. Originally ejection pixels associated with nozzles requiring flushing are few, and it is difficult to eject liquid from a nozzle requiring flushing to a non-ejection pixel adjacent to an ejection pixel associated with the nozzle requiring flushing.

In this liquid ejection method, liquid is ejected from the nozzle requiring flushing to the non-ejection pixel immediately before the nozzle requiring flushing ejects the liquid to the ejection pixel.

With this liquid ejection method, an accurate amount of liquid can be ejected reliably onto ejection pixels from nozzles requiring flushing.

In this liquid ejection method, a nozzle associated with a plurality of the non-ejection pixels that are continuous is determined as the nozzle requiring flushing.

With this liquid ejection method, an accurate amount of liquid is ejected reliably from all nozzles. In nozzles associated with continuous non-ejection pixels, the liquid (ink) tends to thicken near the nozzle, and therefore it is judged that flushing is required.

In this liquid ejection method, a nozzle associated with the ejection pixels fewer than a second predetermined number, among nozzles associated with pixels fewer than a first predetermined number, is determined as the nozzle requiring flushing.

With this liquid ejection method, in the case where for example the nozzles requiring flushing are determined by the number of pixels associated with the nozzles, (for example, a nozzle associated with pixels not less than the first predetermined number from the previous flushing is set as requiring flushing) nozzles having few ejection pixels among the associated pixels are determined as requiring flushing and therefore an accurate amount of liquid is ejected reliably from all nozzles.

Furthermore, a liquid ejection apparatus can be achieved, including: (A) a nozzle that ejects a liquid; and (B) a control portion that determines, according to image data, an ejection pixel that is a pixel at which the liquid is to be ejected and a non-ejection pixel that is a pixel at which the liquid is not to be ejected, that determines, according to the image data, a nozzle requiring flushing, and that ejects the liquid from the nozzle requiring flushing to the non-ejection pixel adjacent to the ejection pixel, the non-ejection pixel being among pixels associated with the nozzle requiring flushing.

With this liquid ejection apparatus, liquid can be ejected by nozzles requiring flushing so as to be inconspicuous in an image. Since there is no stopping of the liquid ejection operations due to flushing, the liquid ejection time can also be reduced.

Also, a program can be achieved for causing a liquid ejection apparatus to achieve determining, according to image data, an ejection pixel that is a pixel at which a liquid is to be ejected and a non-ejection pixel that is a pixel at which a liquid is not to be ejected; determining, according to the image data, a nozzle requiring flushing; and ejecting liquid from the nozzle requiring flushing to the non-ejection pixel adjacent to the ejection pixel, the non-ejection pixel being among pixels associated with the nozzle requiring flushing.

With this program, liquid can be ejected by nozzles requiring flushing so as to be inconspicuous in an image. Since there is no stopping of the liquid ejection operations due to flushing, the liquid ejection time can also be reduced.

System Configuration in the Present Embodiment

In the present embodiment, the liquid ejection apparatus is configured as a system in which an inkjet printer and a computer 50 on which a printer driver is stored are connected. Furthermore, description is given using a line head printer (printer 1) as an example of an inkjet printer.

Figure 2A:
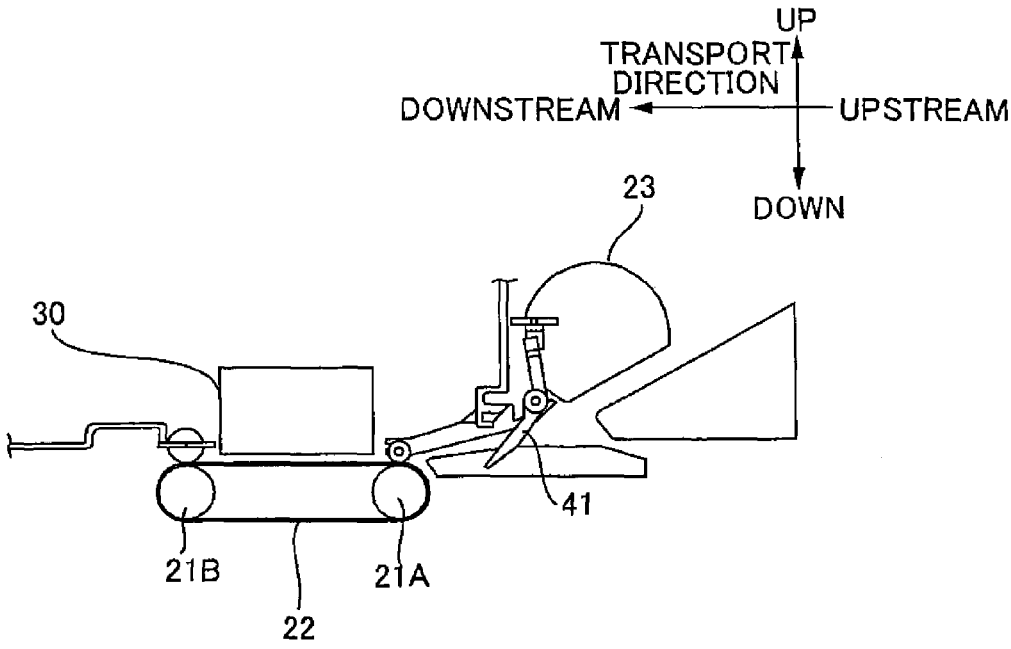
FIG. 2A is a cross-sectional view of the printer.
Figure 2B:
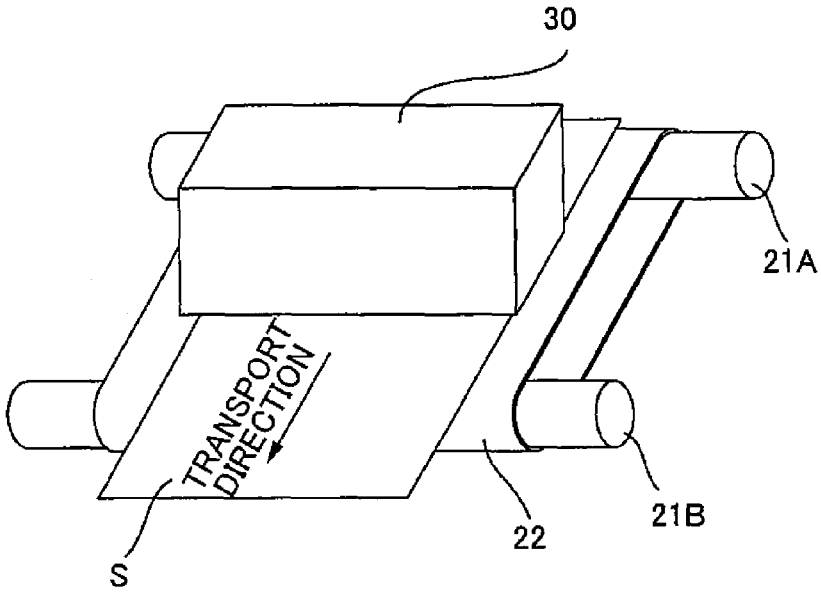
FIG. 2B shows a manner in which the printer transports a paper.

FIG. 1 is a block diagram of an overall configuration of the printer 1 of the present embodiment. FIG. 2A is a cross-sectional view of the printer 1. FIG. 23 shows a manner in which the printer 1 transports a paper S (a medium). Upon receiving print data from the computer 50, which is an external device, the printer 1 controls various units (a transport unit 20 and a head unit 30) using a controller 10 and forms an image on the paper S. Furthermore, a detector group 40 monitors conditions inside the printer 1, and the controller 10 controls the various units based on the detection results.

The controller 10 is a control unit for carrying out control of the printer 1. An interface section 11 is for exchanging data between the computer 50, which is an external device, and the printer 1. A CPU 12 is a computer processing device for carrying out overall control of the printer 1. A memory 13 is for ensuring a region for storing programs of the CPU 12 and a working region or the like. The CPU 12 controls each unit using a unit control circuit 14 according to a program stored in the memory 13.

The transport unit 20 feeds the paper S to a printable position and during printing transports the paper S by a predetermined transport amount in a transport direction. A paper supply roller 23 is a roller for automatically supplying the paper S that has been inserted into a paper insert opening onto a transport belt 22 inside the printer 1. Then, the circular transport belt 22 rotates due to transport rollers 21A and 21B, thereby transporting the paper S on the transport belt 22. Although not indicated in the diagram, it should be noted that the paper S is electrostatically-clamped or vacuum-clamped to the transport belt 22.

The head unit 30 is for ejecting ink onto the paper S and includes a plurality of heads 31. The heads 31 have a plurality of nozzles serving as ink ejection sections. And each nozzle is provided with a pressure chamber (not shown) containing ink, and a drive element (piezo element PZT) for altering the capacity of the pressure chamber to eject ink.

The detector group 40 includes a rotary encoder, a paper detection sensor 41, and an optical sensor, for example.

Configuration of the Head Unit 30

Figure 3A:
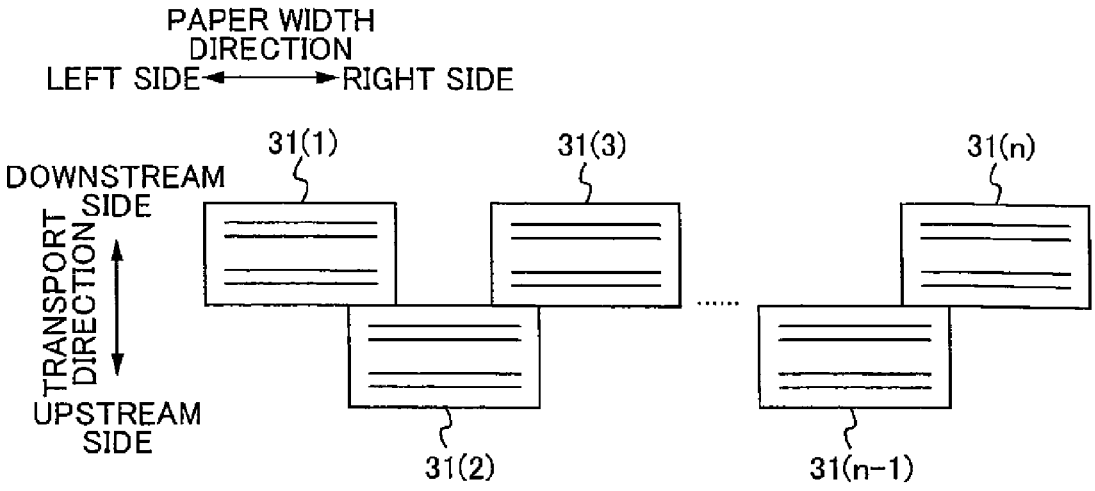
FIG. 3A shows an arrangement of heads on a lower face of a head unit.
Figure 3B:
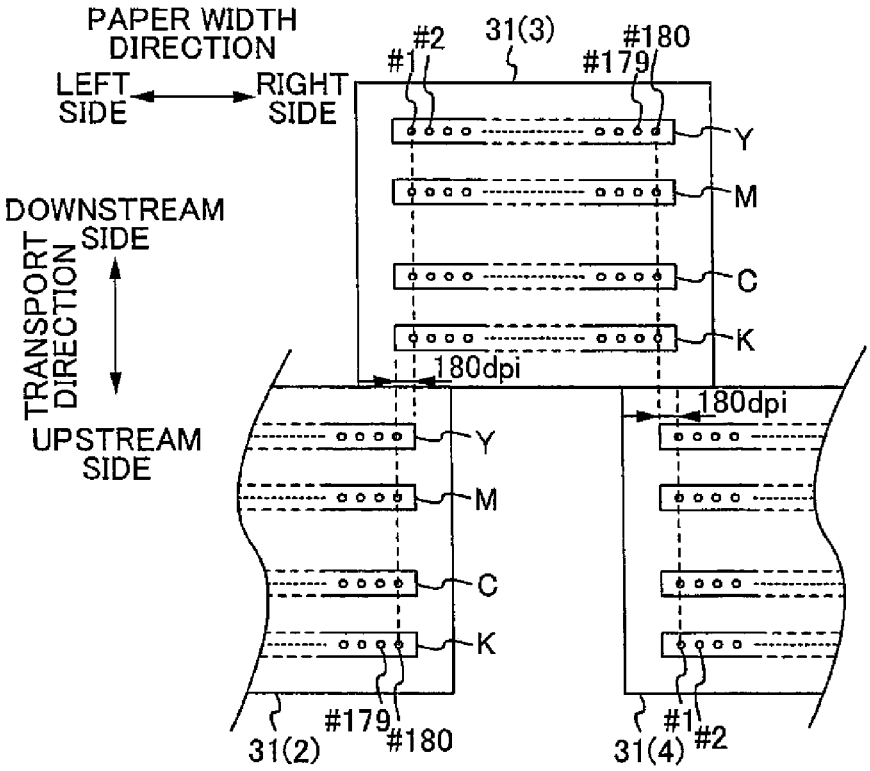
FIG. 3B shows an arrangement of nozzles on lower faces of the heads.

FIG. 3A shows an arrangement of the heads 31 on a lower face of the head unit 30. FIG. 3B shows an arrangement of nozzles on lower faces of the heads 31. The head unit 30 has a plurality of the heads 31. The plurality of heads 31 are arranged in a staggered manner in a paper width direction.

Smaller numbers are assigned in parentheses for the heads 31 further to the left in the paper width direction.

A yellow ink nozzle row Y, a magenta ink nozzle row M, a cyan ink nozzle row C, and a black ink nozzle row K are formed on the lower face of each of the heads 31, and each nozzle row is provided with 180 nozzles. The 180 nozzles are each assigned a number (#i=1 to 180) that is smaller for nozzles further to the left side. And the nozzles of each nozzle row are arranged at a constant spacing of 180 dpi in the paper width direction. Furthermore, the heads 31 are arranged so that of the two heads (31(2) and 31(3)) lined up in the paper width direction, a spacing between the nozzle #180 of the head 31(2) on the left side and the nozzle #1 of the head 31(3) on the right side is 180 dpi. In other words, a length of the nozzle rows lined up in the paper width direction is a largest printable width for paper. Furthermore, the nozzle spacing of 180 dpi is a smallest dot pitch in the paper width direction.

Printing Procedure

Upon receiving a print command and print data from the computer 50, the controller 10 analyzes the content of the commands contained in the print data and carries out the following processes using the units.

First, the controller 10 rotates the paper supply roller 23 to supply the paper S to be printed onto the transport belt 22. Then, the controller 10 rotates the transport rollers 21A and 21B to position the paper 5, which has been fed, to a print commencement position. At this time, the paper S is in opposition to at least some of the nozzles of the head unit 30.

Next, the paper S is transported on the transport belt 22 at a fixed speed without stopping, thereby passing below the head unit 30. While the paper S passes below the head unit 30, ink is ejected intermittently from the nozzles. As a result, a dot row (raster line) constituted by a plurality of dots lined up in the transport direction is formed on the paper S. And after this the controller 10 discharges the paper S, on which printing of an image has been completed, from the transport roller 21B.

Regarding Dot Size

By varying the ink amount ejected from the nozzles, the printer 1 of the present embodiment can distinguish three types of dots (large dots, medium dots, and small dots). That is, the printer 1 can express four gradations by forming "no dot", a "small dot", a "medium dot", or a "large dot" for a single pixel. It should be noted that "pixels" are unit elements that designate rectangular regions virtually defined on the paper S to constitute an image. An image is structured by lining up these pixels in a two dimensional manner.

Figure 4:
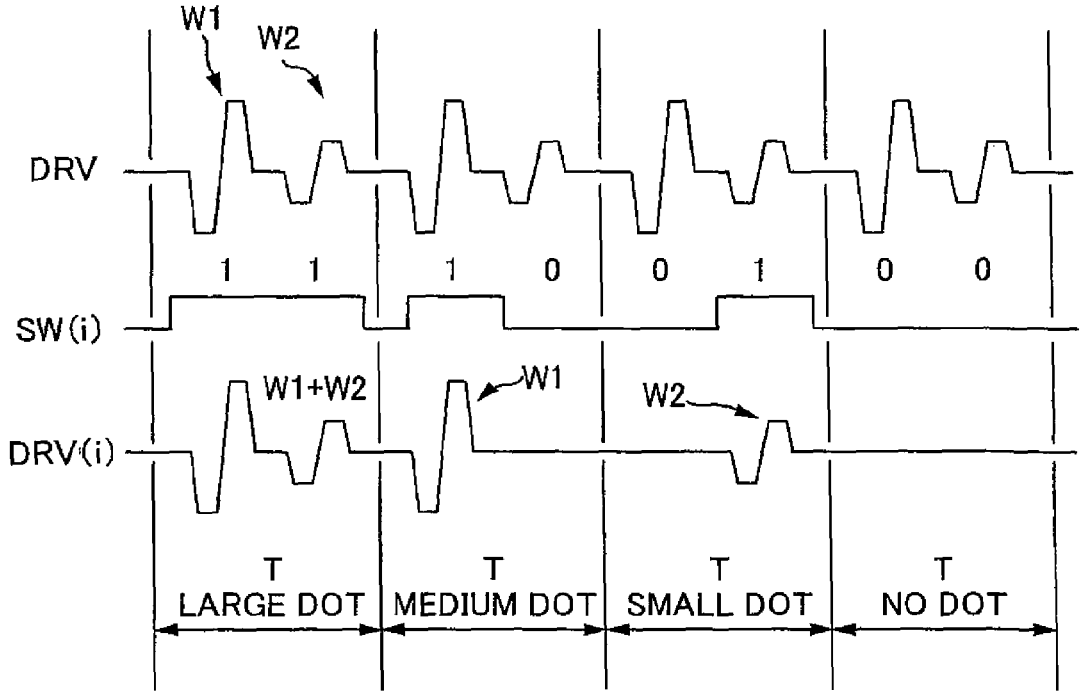
FIG. 4 shows drive signals that are applied to piezo elements.

FIG. 4 shows drive signals DRV that are applied to the piezo elements. The drive signal DRV has a first drive pulse W1 and a second drive pulse W2. Furthermore, the drive signal DRV is applied to or cut off from each piezo element by an on-off operation of a switch (not shown) associated with each piezo element. And the on-off operation of the switch is controlled by a switch control signal SW. For example, when a level of a switch control signal SW(i) is "1", the switch is ON and the drive pulse is applied to the piezo element corresponding to nozzle #i. On the other hand, when the level of the switch control signal SW(i) is "0", the switch is OFF and the drive pulse is cut off without being applied to the piezo element.

Then, the piezo element PZT(i) deforms in response to the drive pulse of the drive signal DRV(i) that has passed through the switch. When the piezo element PZT(i) deforms, an elastic film (side wall), which partitions a portion of the pressure chamber, deforms such that ink inside the pressure chamber is ejected from nozzle #i.

Furthermore, the shape of the drive pulse is determined in advance according to the amount of ink to be ejected. That is, dots of different sizes can be formed according to differences in the drive pulses. For example, in FIG. 4, when the switch control signal SW(i) is "11", the first drive pulse W1 and the second drive pulse W2 are applied to the piezo element PZT (i) and a large dot is formed. As a result of the piezo element PZT(i) deforming due to the first drive pulse W1 and the second drive pulse W2, an ink amount corresponding to a large dot is ejected from nozzle #i.

Similarly, when the switch control signal SW(i) is "10", the first drive pulse W1 is inputted to the piezo element PZT(i) and a medium dot is formed, and when the switch control signal SW(i) is "01", the second drive pulse W2 is inputted to the piezo element PZT(i) and a small dot is formed. When the switch control signal SW(i) is "00", no drive pulse is inputted to the piezo element PZT(i) and no dot is formed.

Flushing Operation

Regarding the Flushing Operation

Water in the ink tends to evaporate at the meniscus of the nozzle (the free surface of ink exposed at the nozzle) and the viscosity of the ink is raised undesirably (thickens) due to this evaporation. When the ink thickens, the nozzles tend to become blocked. Furthermore, bubbles are produced undesirably in the ink when air admixes at the meniscus surface of the nozzle. Due to nozzle blockages and admixing of bubbles, there is a risk that ink will not be ejected or the correct amount of ink will not be ejected when attempting to eject ink from the nozzles according to the print data. As a result, image deterioration occurs.

For this reason, nozzle blockages and admixing of bubbles are eliminated by carrying out a flushing operation. "Flushing operation" refers to an operation of attempting to eject ink that has thickened at the meniscus of the nozzle by applying to the piezo elements drive signals unrelated to image printing. Furthermore, bubbles in the ink are ejected together with the ink.

In this regard, the thickening of ink near the meniscus worsens the more time passes from the previous ejection of ink. Thus it is necessary to carry out the flushing operation for nozzles that do not eject much ink during printing. Conversely, new ink is successively supplied to nozzles from which ink is ejected continuously according to the print data and therefore blockages rarely occur.

Also, in the case where printing has finished and the printer 1 is left in an unoperated state, the ink near the meniscus thickens such that the nozzles become blocked. For this reason, the head 31 (the nozzle face of the head unit 30) is sealed with a cap or the like while no printing operations are being carried out. However, even when the head 31 is capped, ink near the meniscus will thicken when left for a long period and there is a risk that ejection defects will occur. Thus it is necessary to carry out flushing also prior to commencing printing.

Regarding Flushing Operations when Commencing Printing

Figure 5A:
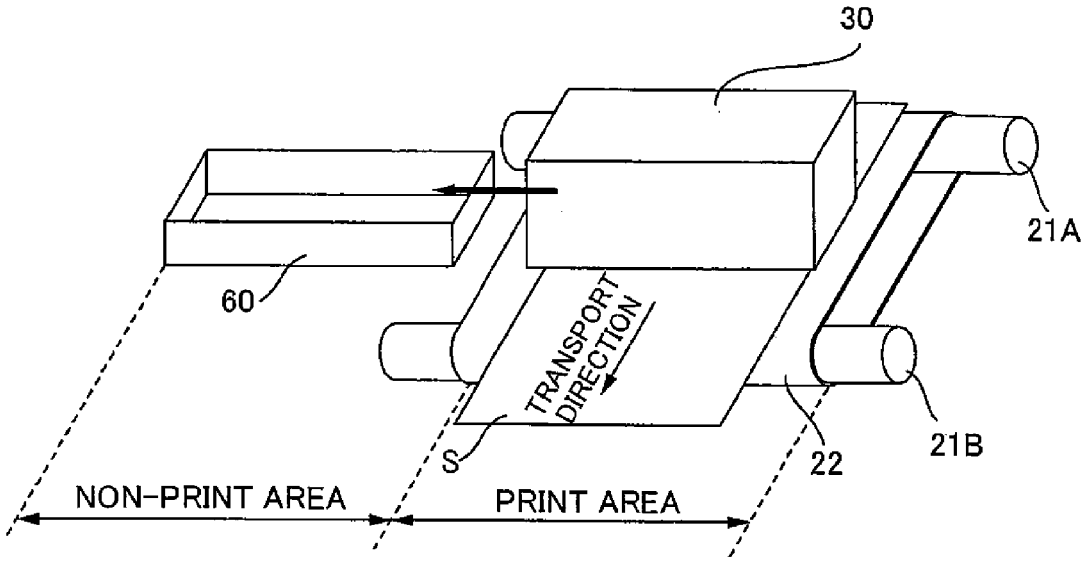
FIG. 5A shows a cap provided in a non-print area.

Next, an example is shown in which the nozzle face is sealed by capping when the printer 1 is in an unoperated state. FIG. 5A shows a cap 60 provided in a non-print area. "Non-print area" refers to a region outside an area (print area) in which the paper S undergoes printing. When the printer is not operated, the head unit moves above the cap 60. Then the nozzle face is sealed by the cap 60. Then, when printing recommences, each of the nozzles carries out flushing toward the cap 60. By doing this, ink that has thickened near the meniscus while the printer is not operated can be ejected such that ink is reliably ejected at the commencement of printing. Furthermore, since the ink is ejected toward the cap 60 in the non-print area, flushing is carried out without any soiling of the paper S or the transport belt 22. That is, the cap 60 serves a role of an ink collecting container.

Figure 5B:
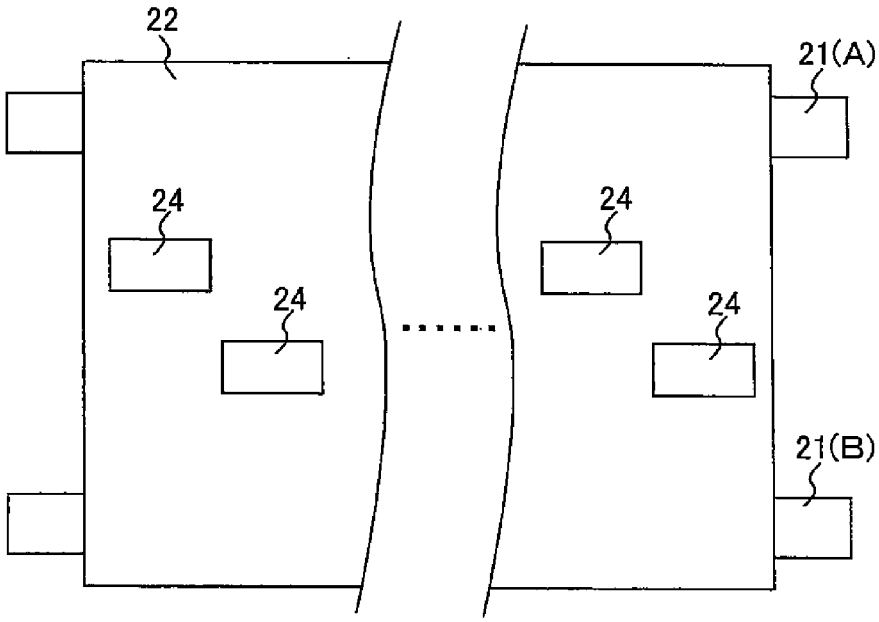
FIG. 5B shows another example of sealing the head using capping.

FIG. 5B shows another example of sealing the head 31 using capping. When the cap is provided in the non-print area as shown in FIG. 5A, the apparatus size is increased undesirably, and therefore holes 24 are provided in the transport belt and caps (not shown) may be provided between the circular transport belt. When the printer is not operated, the position of the transport belt 22 is aligned such that the holes 24 and the head 31 face each other. Then, the caps are raised such that the caps (not shown) pass through the holes 24. Finally, the head 31 is sealed by the caps that protrude from the holes 24. Furthermore, when printing commences, ink is ejected toward the caps that face the heads, thereby enabling ink to be ejected reliably when printing commences without soiling the transport belt 22 or the paper S. However, when the holes 24 are provided in the transport belt, the strength of the belt is reduced undesirably.

At times other than when printing is not performed also, ink near the meniscus of any nozzle that does not eject much ink during printing also thickens undesirably. That is, depending on the nozzle, the flushing operation is necessary not only at the commencement of printing, but during printing as well. Next, after giving a comparative example of flushing during printing, description is given regarding flushing during printing according to the present embodiment.

Comparative Example

Flushing During Printing

In this comparative example, flushing is carried out periodically for all nozzles so that nozzles that do not eject much ink during printing can eject ink reliably when they do eject ink. For example, a timing is set in advance to carry out flushing such that flushing is carried out one time when the paper S has been transported halfway or flushing is carried out one time when three pages of printing has been completed.

Furthermore, in the comparative example, flushing is carried out also during printing using capping. For this reason, it is necessary for the head 31 and the caps to be made to oppose each other during printing and for ink to be ejected from the nozzles toward the caps. For example, if the printer 1 is provided with a cap in the non-print area as in FIG. 5A, the head unit 30 is moved into opposition to the cap 60 during printing, and once flushing is finished, it is necessary to again move the head unit 30 to the print area. Furthermore, in the case where the printer 1 is provided with the holes 24 in the transport belt 22 as in FIG. 5B, it is necessary to align the position of the transport belt 22 so that the head 31 and the holes 24 are in opposition during printing.

In other words, when flushing is to be carried out during printing using capping, time is required during flushing operation for moving the head unit 30 and for making the head and caps oppose each other. Furthermore, while flushing is carried out, printing operations are stopped. That is, the print time is lengthened undesirably by carrying out flushing using capping during printing. Accordingly, it is an advantage of the present embodiment to shorten the flushing time during printing.

Present Embodiment

Regarding Flushing During Printing

In the present embodiment, in order to shorten the flushing time during printing, flushing using capping is not carried out during printing. However, in the case where capping is not used, the transport belt 22 and the like will become soiled undesirably when ink is ejected indiscriminately from the nozzles during flushing. Accordingly, in the present embodiment, ink unrelated to image forming is ejected toward the paper S during printing from nozzles requiring flushing. Nozzles requiring flushing refers to nozzles that infrequently eject ink for image forming, and therefore ink unrelated to image forming is ejected onto the paper S in order to prevent blockages (details are described later).

By carrying out flushing without using capping, the movement time of the head unit 30 and the time for making the head 31 and the cap oppose each other is eliminated, thereby enabling the printing time to be reduced. Furthermore, ejection of ink for printing and ejection of ink for flushing is carried out at the same time, and therefore there is no stopping of printing operations for flushing. As a result, the printing time can be reduced.

However, when nozzles requiring flushing eject ink during printing, dots are formed on the paper S. The dots formed for flushing (flushing dots) are dots unrelated to image forming. Thus it becomes a cause of image deterioration when flushing dots become undesirably conspicuous in a finished image.

Accordingly, the present embodiment is configured so that flushing dots in the image do not become conspicuous (details are described later). Furthermore, in the flushing during printing of the comparative example, flushing is carried out periodically for all the nozzles, but in the present embodiment flushing is carried out only for the nozzles requiring flushing.

Furthermore, in causing ink to be ejected from nozzles requiring flushing during printing, it is necessary to overwrite print data (intermediate print data), which is only for image forming, to print data (final print data) for carrying out image forming and flushing. Intermediate print data is first generated in accordance with the printer driver stored in the memory of the computer 50, after which the intermediate print data is overwritten by the final print data. The printer driver is a program that causes the computer 50 to generate print data and that causes to send the print data to the printer 1. That is, in the present embodiment, the liquid ejection apparatus is configured as a system in which the inkjet printer and the computer on which the printer driver is stored are connected.

That is to say, the printer driver is a control portion including a step of determining, according to image data, an ejection pixel that is a pixel at which liquid is to be ejected and a non-ejection pixel that is a pixel at which liquid is not to be ejected, a step of determining, according to the image data, a nozzle requiring flushing, and a step of ejecting liquid from the nozzle requiring flushing to the non-ejection pixel adjacent to the ejection pixel, the non-ejection pixel being among pixels associated with the nozzle requiring flushing.

Regarding Intermediate Print Data Generation

Figure 6:
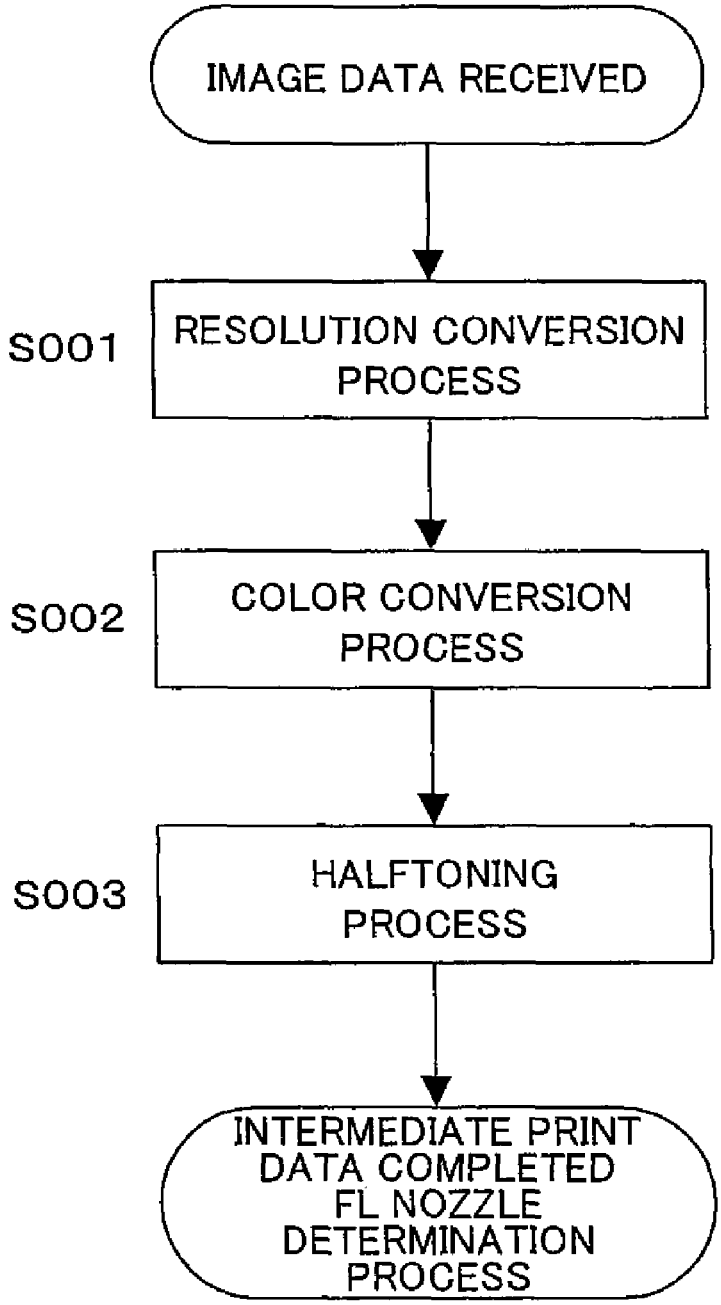
FIG. 6 is a flowchart of an intermediate print data generating process.

FIG. 6 is a flowchart of an intermediate print data generating process. First, the printer driver receives image data of an image a user desires to print from an application software.

Then the printer driver converts the received image data to a resolution for printing (resolution conversion process, S001). It should be noted that the image data after the resolution conversion process in the present embodiment is data (RGB data) having 256 gradations expressed using an RGB color space. Here, "image data" is a collection of data indicating pixels. That the image data is data having 256 gradations means a single pixel is expressed in 256 gradations and a single pixel is indicated by 8-bit data ($2^8$=256).

Next, the printer driver converts the RGB data to CMYK data that is expressed using a CMYK color space corresponding to the inks of the printer 1 (color conversion process, S002). The color conversion process is performed by the printer driver referencing a table (not shown) in which tone values of RGB data are associated with tone values of CMYK data.

Finally, the printer driver converts the data of a high number of gradations (256 gradations) to data of a number of gradations that can be formed by the printer 1 (halftoning process, S004). The printer 1 of the present embodiment can form three types of dots (large, medium, and small). Thus, in the halftoning process, data of 256 gradations is converted to data of four gradations (2-bit data).

The image data received from the application software is converted to intermediate print data by the above-described processing. Intermediate print data is data indicating for each pixel the type of dot to be formed or that no dot is to be formed. And an image is accomplished by forming dots based on the intermediate print data.

Furthermore, the intermediate print data is generated for each ink (CMYK) of the printer 1. For example, when the intermediate print data of cyan corresponding to a certain pixel indicates "10 (medium dot)", a cyan medium dot is formed in that certain pixel. Also, when the intermediate print data of magenta corresponding to a certain pixel indicates "00 (no dot)", no magenta dot is formed in that certain pixel. Hereinafter, in order to simplify description, description is given relating to nozzles of one color without distinguishing according to color.

Regarding Nozzles Requiring Flushing

FIG. 7A shows a manner of dots formed based on intermediate print data. FIG. 7B shows sizes of dots that are formed. The printer 1 has a multitude of nozzles, but to simplify description only five nozzles are shown in FIGS. 7A and 7B. Furthermore, the number of pixels in the paper width direction for an image of one page is set to five pixels and the number of pixels in the transport direction is set to ten pixels. And the printer 1 carries out bordered printing. With bordered printing, the image to be printed is smaller than the printing paper and white space is formed at the edges of the paper. Furthermore, to specify the locations of pixels, the pixel rows along the paper width direction are indicated as "lines" and the pixel rows along the transport direction are indicated as "rows". Smaller numbers are assigned to lines further to the downstream side (leading edge side of the paper) in the transport direction and smaller numbers are assigned to rows further to the left side in the paper width direction. It should be noted that pixels further to the downstream side come into opposition to the nozzles earlier. That is, pixels further to the downstream side come into opposition to nozzle #i earlier and dots are formed there earlier when dots are to be formed.

In FIG. 7A there are pixels in which dots are formed and pixels in which dots are not formed. Here, pixels in which dots are to be formed are referred to as "ejection pixels" and pixels in which dots are not to be formed are referred to as "non-ejection pixels". And each pixel in the image is associated with one of the nozzles among the nozzles of the printer 1. For example, pixels in row 1 are associated with nozzle #1, and ink is ejected from nozzle #1 when a dot is to be formed in a pixel pertaining to row 1. Nozzle #1 forms five medium dots while the printer 1 prints the image of page 1. On the other hand, nozzle #2, which is associated with pixels of row 2, forms three medium dots. In other words, the number of ejection of ink varies depending on the nozzle.

The printer driver can recognize how many dots each nozzle is to form according to the intermediate print data. Furthermore, the printer driver can check the timing at which ink is to be ejected from each nozzle according to the intermediate print data.

In this regard, nozzles having a long interval between a preceding ejection and a subsequent ejection require flushing during printing so that blockages do not occur. The printer driver checks the timing at which ink is to be ejected from each nozzle according to the intermediate print data and performs flushing for nozzles having long ejection intervals. In other words, nozzles having long ejection intervals are nozzles that require flushing.

In the present embodiment, after ink has been ejected from nozzle #i for a certain pixel, if ink is not ejected for the subsequent five pixels from nozzle #i, then nozzle #i is set as requiring flushing. Here, in the case where ink is not ejected for five pixels after ink has been ejected from nozzle #i, there is a risk that nozzle #i will become blocked during that time. That is, when there are five continuous non-ejection pixels among the pixels associated with nozzle #i, flushing is carried out for nozzle #i. For example, in FIG. 7A, among the pixels of row 2 associated with nozzle #2, there are five continuous non-ejection pixels from line 2 to line 6. Ink is not ejected from nozzle #2 while the pixels for row 2 from line 2 to line 6 on the paper S are transported under nozzle #2, and therefore there is a risk that nozzle #2 will become blocked. In the case where nozzle #2 becomes completely blocked, ink will not be ejected when attempting to eject ink from nozzle #2 for the pixel at line 7. Furthermore, even if nozzle #2 is not completely blocked, this is a cause of ejection irregularities such as reduced amounts of ejection or shifted ejection directions, and dots are not formed correctly in pixels where dots are to be formed, which leads to image deterioration.

Accordingly, in the present embodiment, ink is ejected from nozzle #i to one of the pixels among the five continuous non-ejection pixels. Here, a dot that is formed by ejecting ink from a nozzle for flushing is referred to as a flushing dot. And a pixel in which a flushing dot is to be formed is referred to as a "pixel for flushing". Although a pixel for flushing is a non-ejection pixel (a pixel indicated as "00") in the intermediate print data, it is converted from a non-ejection pixel to an ejection pixel in a final print data generating process (described later).

Next, description is given of a method for determining pixels for flushing. Upon confirming from the intermediate print data that there are five continuous non-ejection pixels, the printer driver determines one of the five continuous non-ejection pixels as a pixel for flushing. Furthermore, since the flushing dot is a dot unrelated to the image specified by the user, it is necessary that the flushing dot is formed so as to not be conspicuous in the image.

For this reason, in the present embodiment, the flushing dot is formed next to a pixel in which a large dot (or a medium dot), which is the largest size dot formable by the printer 1, is formed. And the flushing dot is equivalent in size to a small dot. In the present embodiment, a large dot (for example, row 3, line 4 in FIG. 7A) is of a size extending beyond a single pixel. For this reason, if a flushing dot is formed in a pixel next to a pixel in which a large dot is formed, the large dot and the flushing dot overlap, and the flushing dot becomes inconspicuous.

Accordingly, when the printer driver recognizes that there are five continuous non-ejection pixels, it checks whether or not a large dot is to be formed in a pixel adjacent to the continuous non-ejection pixels. Here, pixels adjacent to the continuous non-ejection pixels (row 2, line 2 to line 6) are pixels adjacent to the non-ejection pixels in the paper width direction (row 1, line 2 to line 6 and row 3, line 2 to line 6), pixels adjacent to the non-ejection pixels in the transport direction (row 2, line 1, and row 2, line 7), and pixels diagonally adjacent to the non-ejection pixels in the paper width direction (row 1, line 1; row 3, line 1; row 1, line 7; and row 3, line 7).

In FIG. 7A, among pixels adjacent to the pixels in row 2, line 2 to line 6, a large dot is to be formed in the pixel of row 3, line 4. Accordingly, the printer driver determines as the pixel for flushing the non-ejection pixel of row 2, line 4, which is adjacent to the pixel of row 3, line 4. Then, although the data for the pixel of row 2, line 4 in the intermediate print data indicates "no dot to be formed (00)", this is overwritten to "flushing dot (=small dot) to be formed (01)". In this manner, the intermediate print data, which is only for forming the image, is overwritten to the final printer driver, which is for carrying out image forming and flushing.

Furthermore, in FIG. 7A, there are also five continuous non-ejection pixels in the pixels of row 5, line 5 to line 9. However, no large dot is to be formed in the pixels adjacent to the pixels of row 5, line 5 to line 9. If there is a case where no large dot is to be formed in the pixels adjacent to the continuous non-ejection pixels, the printer driver checks whether or not a medium dot is to be formed in the adjacent pixels. Then, in the case where a medium dot is to be formed in the adjacent pixels, the non-ejection pixel adjacent to the pixel in which the medium dot is to be formed is set as a pixel for flushing. In the present embodiment, a medium dot is of size that is contained within a single pixel, and therefore the medium dot and the flushing dot do not overlap, but the flushing dot is less conspicuous than forming the flushing dot in a white space area.

It should be noted that in the case where there are multiple pixels in which medium dots are to be formed among the pixels adjacent to the continuous non-ejection pixels, the flushing dot is formed in the pixel adjacent to the most upstream side pixel, among the pixels in which medium dots are to be formed (details are described later). In FIG. 7A, the pixel of row 4, line 6 is positioned further to the upstream side than the pixel of row 5, line 4, and therefore the pixel of row 5, line 6, which is adjacent to the pixel of row 4, line 6, is set as the pixel for flushing.

FIG. 7C shows a manner of dots formed based on final print data. To distinguish small dots and flushing dots (FL dots), small dots are indicated by empty circles (○) and FL dots are indicated by solid circles (●). Among the continuous non-ejection pixels, a flushing dot is formed in the pixel (row 2, line 4) adjacent to the pixel in which a large dot is formed. And among the continuous non-ejection pixels, a flushing dot is formed in the pixel (row 5, line 6) adjacent to the pixel on the upstream side in which a medium dot is formed.

Then, the printer driver again checks for numbers of continuous non-ejection pixels from the next pixels (pixels on the upstream side) of pixels for flushing. For example, if row 5, line 6 is determined as a pixel for flushing, the printer driver judges that the non-ejection pixels from row 5, line 7 to row 5, line 10 are continuous. For this reason, in the case where there are multiple pixels in which large dots (or medium dots) are to be formed among the pixels adjacent to the continuous non-ejection pixels, the flushing dot is formed in the pixel adjacent to the most upstream side pixel in which the large dots are to be formed. This is because if the next pixel after the pixel for flushing is also a non-ejection pixel, the number of times of flushing can be reduced by using the upstream side pixel as the pixel for flushing.

Figure 8A:
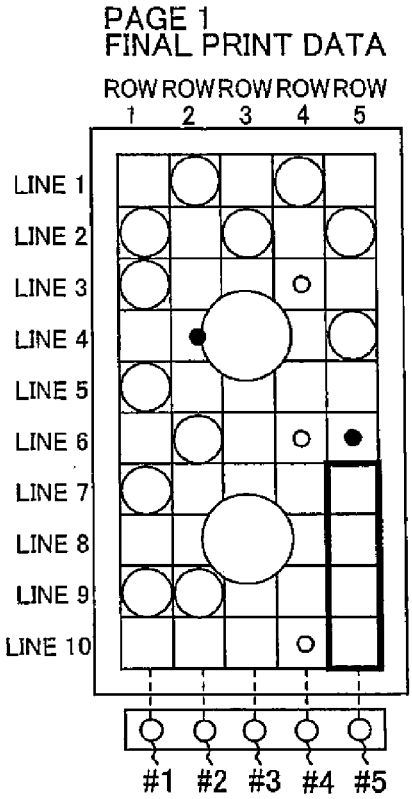
FIG. 8A shows page 1 of an image based on final print data.
Figure 8B:
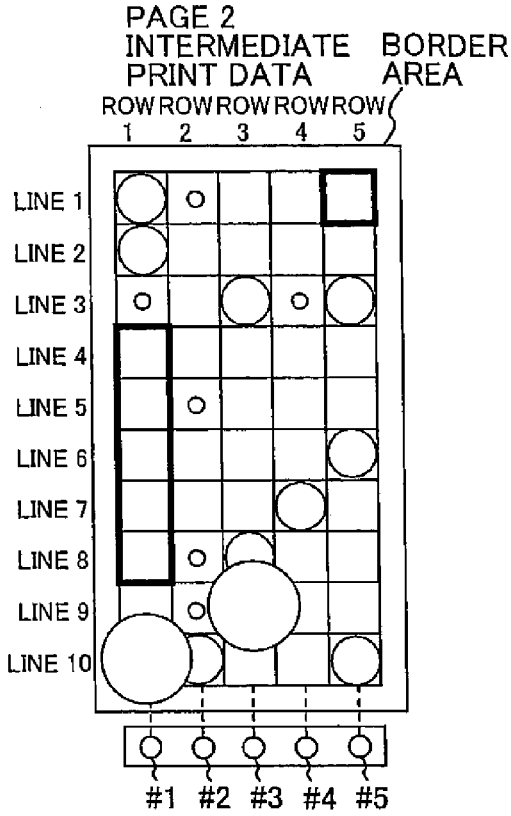
FIG. 8C shows page 2 of an image based on final print data.

Next, description is given regarding a case where a plurality of pages of images are to be printed. FIG. 8A shows page 1 of an image based on final print data. FIG. 8B shows page 2 of an image based on intermediate print data. In the case where a plurality of pages of images are to be printed, the printer driver determines the nozzles requiring flushing giving consideration also to the number of non-ejection pixels of the immediately preceding page.

For example, the pixels (FIG. 8A) of row 5, line 7 to line 10 associated with nozzle #5 of page 1 are non-ejection pixels. And the pixel (FIG. 8B) of row 5, line 1 of page 2 is also a non-ejection pixel. If the printer driver did not give consideration to the number of non-ejection pixels of the immediately preceding page, then the printer driver would not be able to determine nozzle #5 as a nozzle requiring flushing even though ink from nozzle #5 is not ejected for five continuous pixels from page 1, row 5, lines 7 to 10 until page 2, row 5, line 1. As a result, there is a risk that nozzle #5 will be blocked when attempting to eject ink from nozzle #5 to the pixel of row 5, line 3, which is the first ejection pixel on page 2.

For this reason, in the present embodiment, in the case where a plurality of pages of images are to be printed, the printer driver determines the dots requiring flushing giving consideration to the non-ejection pixels of the immediately preceding page. By doing this, flushing is performed when required even though time has passed from the final ejection on the immediately preceding page, and therefore a dot can be formed correctly for the first ejection pixel on the next page.

Incidentally, neither large dots nor medium dots are to be formed in pixels adjacent to pixels from page 1, row 5, line 7 to line 10 until page 2, row 5, line 1. Furthermore, neither large dots nor medium dots are to be formed in pixels adjacent to pixels in page 2, row 1, line 4 to line 8. In a case such as this, the printer driver forms a flushing dot in an inconspicuous location. A location in which a flushing dot is inconspicuous includes for example forming the flushing dot in a border area in bordered printing or in a pixel that although not adjacent, is near a pixel in which a large dot or a medium dot is to be formed.

Figure 8C:
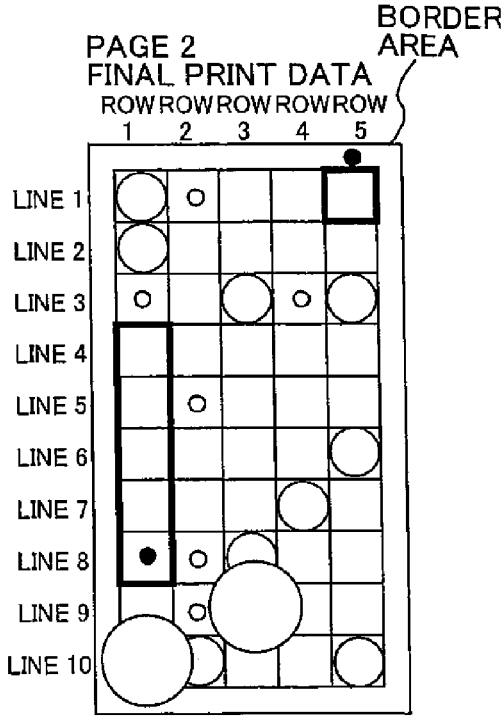

FIG. 8C shows page 2 of an image based on final print data. In a case of bordered printing where non-ejection pixels are continuous extending over a plurality of pages as in the pixels of page 1, row 5, line 7 to line 10 until page 2, row 5, line 1, the printer driver forms a flushing dot in the border area. Among the pixels on page 2, row 1, from line 4 to line 8, since more large dots and medium dots are formed in pixels near upstream side pixels compared to near downstream side pixels, the printer driver forms the flushing dot in the pixel of row 1, line 8 on the most upstream side.

It should be noted that in the case where no large dots or medium dots are formed near the non-ejection pixels or in the case where there is no lopsidedness in dot formation in the upstream side and the downstream side among the non-ejection pixels, the most upstream side pixel is set as the pixel for flushing. That is, when there is a plurality of candidates for the pixel for flushing, the candidate on the most upstream side is set as the pixel for flushing. By doing this, if a non-ejection pixel follows after the pixel for flushing, the number of times of flushing can be reduced.

In this manner, in the present embodiment, the printer driver determines nozzles requiring flushing based on the intermediate print data and causes ink to be ejected from the nozzles requiring flushing onto an appropriate location.

Regarding Final Print Data Generation

Figure 9:
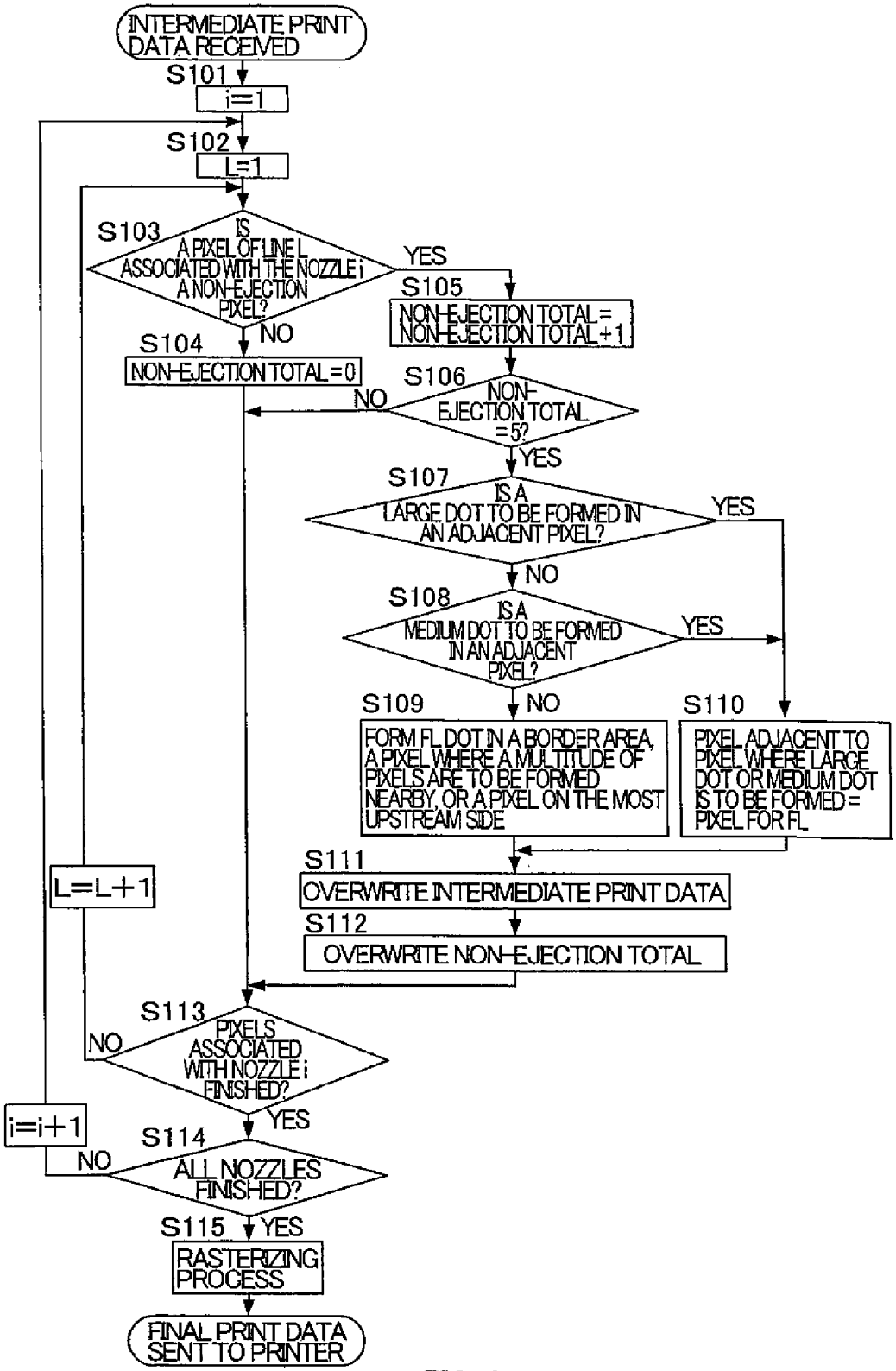
FIG. 9 is a flowchart in which the printer driver determines pixels for flushing and generates final print data.

FIG. 9 is a flowchart in which the printer driver determines pixels for flushing and generates final pixel data. Based on the intermediate print data, the printer driver checks each nozzle as to whether or not flushing is required, then determines the timings for carrying out flushing. For example, in FIG. 7A, the printer driver checks (S101) whether or not flushing is required in order from the leftmost side nozzle #1 (i=1).

Then the printer driver checks (S103) whether or not each pixel associated with nozzle #1 is a non-ejection pixel in the order of pixels that pass under nozzle #1 (L=line 1, S102). That is, it checks whether or not there is a non-ejection pixel in order from the pixels of line 1 in FIG. 7A, then the pixels of line 2, the pixels of line 3 and so forth. Furthermore, in the case where a plurality of pages are to be printed, it checks in order from the intermediate print data of page 1.

Then, if a pixel checked by the printer driver is a non-ejection pixel (S103→yes), then a value of a non-ejection total is updated (S105: non-ejection total=previous non-ejection total+1). Here, "non-ejection total" refers to a number of times non-ejection pixels are continuous. On the other hand, if a pixel checked by the printer driver is an ejection pixel (S103→no), then the non-ejection total is reset to zero "0" (S104).

When the value of the non-ejection total is updated at S105, the printer driver checks whether or not the value of the non-ejection total is five (S106). When the value of the non-ejection total is not five (S106→no) or when the value of the non-ejection total has been reset to 0 (S104), there is no need yet to carry out flushing for nozzle Then, if all the checking of pixels associated with nozzle #i is not finished (S113→no), then the printer driver checks whether or not the next pixel is a non-ejection pixel.

For example, in FIG. 7A, first the pixel of row 1, line 1 associated with nozzle #1 is a non-ejection pixel, and therefore the non-ejection total becomes 1 (=0+1). After this, the printer driver checks whether or not the pixel of row 1, line 2 is a non-ejection pixel. The pixel of row 1, line 2 is an ejection pixel, and therefore the non-ejection total becomes 0. The pixels associated with nozzle #1 do not have five continuous non-ejection pixels and therefore the non-ejection total does not become five. As a result, the printer driver judges that nozzle #1 is a nozzle that does not require flushing. Then, since all the checking of pixels associated with nozzle #1 is finished (S113→yes) and there are nozzles remaining for which checking is not finished (S114→no), the printer driver carries out checking of the pixels associated with the next nozzle, which is nozzle #2.

Then there are five continuous non-ejection pixels from line 2 to line 6 among the pixels of row 2 associated with nozzle #2. Thus, when the printer driver checks the pixel of row 2, line 6, the non-ejection total becomes 5=4+1 (S106→yes). That is, the non-ejection total becoming 5 means that there are five continuous non-ejection pixels, and therefore it is necessary to form a flushing dot in one of the pixels of the five continuous non-ejection pixels.

Accordingly, next, the printer driver checks (S107) whether or not a large dot is formed in the pixels adjacent to row 2, line 2 to line 6. In FIG. 7A, a large dot is formed in the pixel of row 3, line 4 (S107→yes), and the non-ejection pixel of row 2, line 4 adjacent to the pixel of row 3, line 4 is set as the pixel for flushing (FL pixel) (S110). If there is a case where no large dot is to be formed in the pixels adjacent to row 2, line 2 to line 6 (S107→no), the printer driver checks (S108) whether or not a medium dot is to be formed in the adjacent pixels. In the case where a medium dot is to be formed in the adjacent pixels (S108→yes), the non-ejection pixel adjacent to the pixel in which the medium dot is to be formed is set as a pixel for flushing.

On the other hand, in the case where neither a large dot nor a medium dot is to be formed in the pixels adjacent to the continuous non-ejection pixels (S108→no), the flushing dot is set (S109) to be formed in a location in which the flushing dot is inconspicuous (a border area of the printing paper, a pixel where a multitude of pixels are to be formed nearby, or a pixel on the most upstream side).

Once the location (pixel) in which the flushing dot is to be formed is determined in this manner, the intermediate print data is overwritten by the final print data in which flushing dots are formed (S111). That is, the printer driver overwrites no dot (00) data to data (01) in which a flushing dot (small dot) is formed. After this, the non-ejection total is converted from the pixels for flushing (S112). For example, after the printer driver checks the pixel of row 2, line 6 and the non-ejection total has become 5, in FIG. 7C a flushing dot is to be formed in the pixel of row 2, line 4, and therefore the continuous non-ejection pixels become the two pixels of row 2, line 5 and line 6 such that the non-ejection total becomes 2.

Then, when checking the necessity for flushing of all the nozzles has finished (S114→yes), the printer driver performs the rasterizing process on the final print data, which has been converted from the intermediate print data. The rasterizing process is a process in which image data in a matrix form is rearranged for each set of pixel data to an order suitable for transfer to the printer 1. Thus, the final print data, which has been converted from the intermediate print data so as to include the forming of flushing dots, is sent by the printer driver to the printer 1 along with command data (transport amounts and the like) corresponding to a printing method.

In this manner, in the present embodiment, flushing dots are formed in the image by ejecting ink to the paper S from the nozzles during printing as necessary without carrying out flushing using capping during printing. By doing this, the flushing time can be reduced. Furthermore, since there is no stopping of printing operations due to flushing, the printing time can also be reduced.

Incidentally, in the comparative example, flushing is carried out periodically for all the nozzles. Thus, ink is also ejected toward the cap from nozzles not requiring flushing, which consumes ink for no purpose. In contrast to this, in the present embodiment, the printer driver checks whether or not each pixel is a non-ejection pixel based on the image data (intermediate print data). Then it determines whether or not flushing is necessary for each nozzle and carries out flushing only for nozzles requiring flushing. Thus, consuming ink for no purpose due to flushing can be avoided.

And in the present embodiment, flushing dots are formed in non-ejection pixels associated with nozzles requiring flushing and are pixels adjacent to pixels in which a large dot (or a medium dot) is to be formed. By doing this, it is possible to avoid image deterioration in which flushing dots are conspicuous in the printed image.

It should be noted that in the case where a large dot (medium dot) is not to be formed in the pixels adjacent to the non-ejection pixels associated with the nozzles requiring flushing, the flushing dots are formed in pixels in which the number of times of flushing can be reduced and the flushing dots are as inconspicuous as possible (such as a border area of the printing paper, a pixel where a multitude of dots are to be formed nearby, or a pixel on the most upstream side).

Figure 10A:
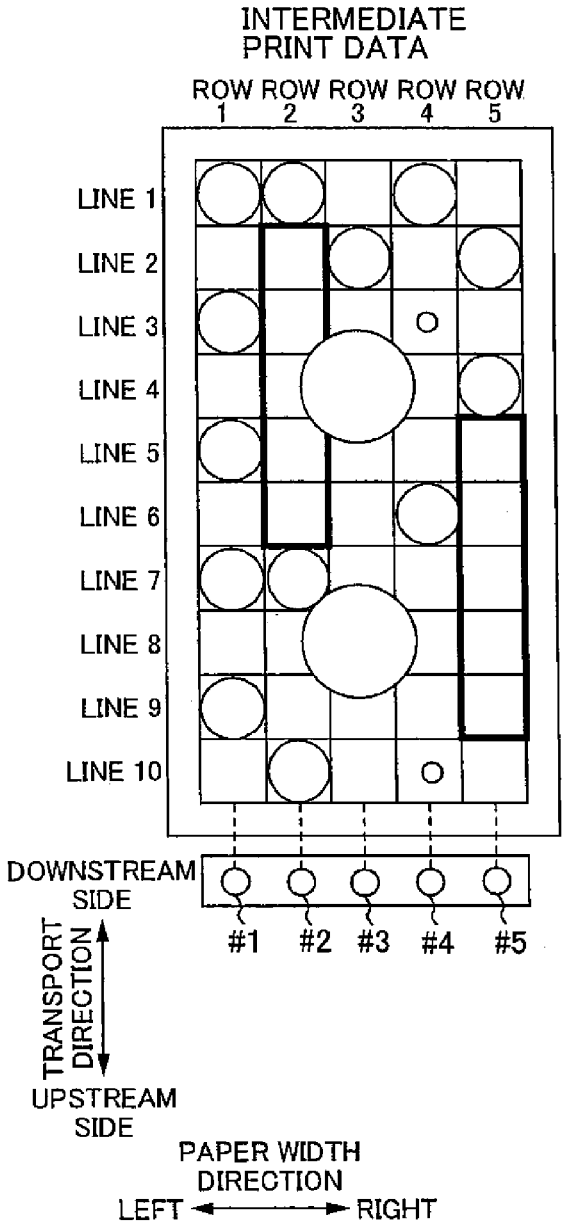
FIG. 10A shows a manner of dots formed based on intermediate print data.
Figure 10B:
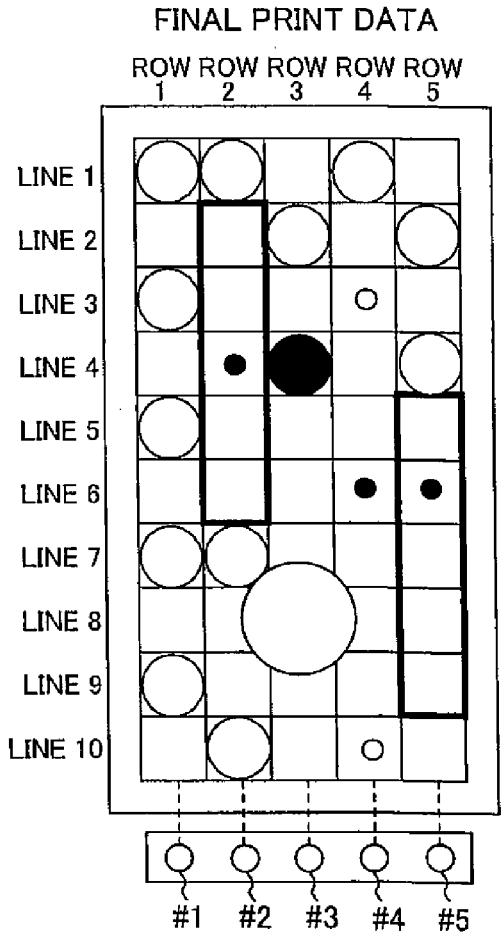
FIG. 10B shows a manner of dots formed based on final print data.

FIG. 10A shows a manner of dots formed based on intermediate print data. FIG. 10B shows a manner of dots formed based on final print data. In FIG. 10A the pixels in row 2, line 2 to line 6 are non-ejection pixels and therefore it is necessary to form a flushing dot in a pixel (row 2, line 4) adjacent to a pixel (row 3, line 4) in which a large dot is to be formed. Similarly, among the continuous non-ejection pixels (row 5, line 5 to line 9), a flushing dot is formed in the pixel (row 5, line 6) adjacent to the pixel (row 4, line 6) in which a medium dot is to be formed. In this case, it is possible to change the large dot (row 3, line 4 in FIG. 10A) adjacent to the flushing dot to a medium dot (row 3, line 4 in FIG. 10B) and to change the medium dot (row 4, line 6 in FIG. 10A) adjacent to the flushing dot to a small dot (row 4, line 6 in FIG. 10B). This is because if flushing dots are formed excessively in the printed image, there is a possibility that the density of those locations will become darker.

Modified Example

In the present embodiment, when there are five continuous non-ejection pixels (the number of continuous non-ejection pixels is set low at 5 pixels as a reference to simplify description, but 5 pixels is only one example and this may be set by finding based on testing or the like a non-ejection period in which there is a possibility of thickening occurring in a nozzle), the printer driver forms a flushing dot in a pixel among the five continuous non-ejection pixels, but there is no limitation to this. For example, the following improved example is also possible.

In FIG. 7A, there are five continuous non-ejection pixels in row 5, line 5 to line 9. In the present embodiment, at the point in time when the printer driver has checked whether or not the pixel of row 5, line 9 is a non-ejection pixel, a flushing dot is formed among the five continuous non-ejection pixels. However, it is also possible to check whether or not the non-ejection pixels continue after there are five continuous non-ejection pixels. In FIG. 7A, row 5, line 10 is also a non-ejection pixel. If the pixel of row 5, line 10 is the final pixel associated with nozzle #5, then the nozzle #5 does not require flushing. That is, it is also possible to set this so that the printer driver checks whether or not the non-ejection pixels continue after there are five continuing non-ejection pixels and if the non-ejection pixels continue to the end of printing, flushing is not carried out.

Furthermore, it is also possible to check how many non-ejection pixels are continuous after five continuous non-ejection pixels and to form the flushing dot in a non-ejection pixel on the upstream side other than the five continuous non-ejection pixels. For example, it is also possible to form the flushing dot in a non-ejection pixel immediately before an ejection pixel in a case for example where there are more than five non-ejection pixels until the next ejection pixel and a large dot is to be formed in a pixel adjacent to the non-ejection pixel immediately before (downstream side) the next ejection pixel. And in this case, so that the thickening in the nozzle does not worsen such that the nozzle cannot be recovered after one time of flushing, when the continuous non-ejection pixels exceed a predetermined number, it is also possible to separately set the predetermined number so that a flushing dot is formed in a pixel midway among the ejection pixels.

Second Embodiment

In the foregoing embodiment, the printer driver checks whether or not each pixel in image data (intermediate print data) is a non-ejection pixel to determine nozzles requiring flushing. In contrast to this, in a second embodiment, flushing is performed for nozzle #i once a fixed number of pixels on the paper S has passed under nozzle #i from the previous flushing regardless of the number of dots formed by nozzle #i. In other words, in the second embodiment, flushing is performed for nozzle #i according to the number of pixels associated with nozzle #i. Furthermore, flushing is performed for nozzle #i if the number of dots to be formed by nozzle #i is small even if the fixed number of pixels on the paper S has not passed under nozzle #i. It should be noted that nozzles requiring flushing are determined by the printer driver based on the intermediate print data in a same manner as the foregoing embodiment.

Figure 11:
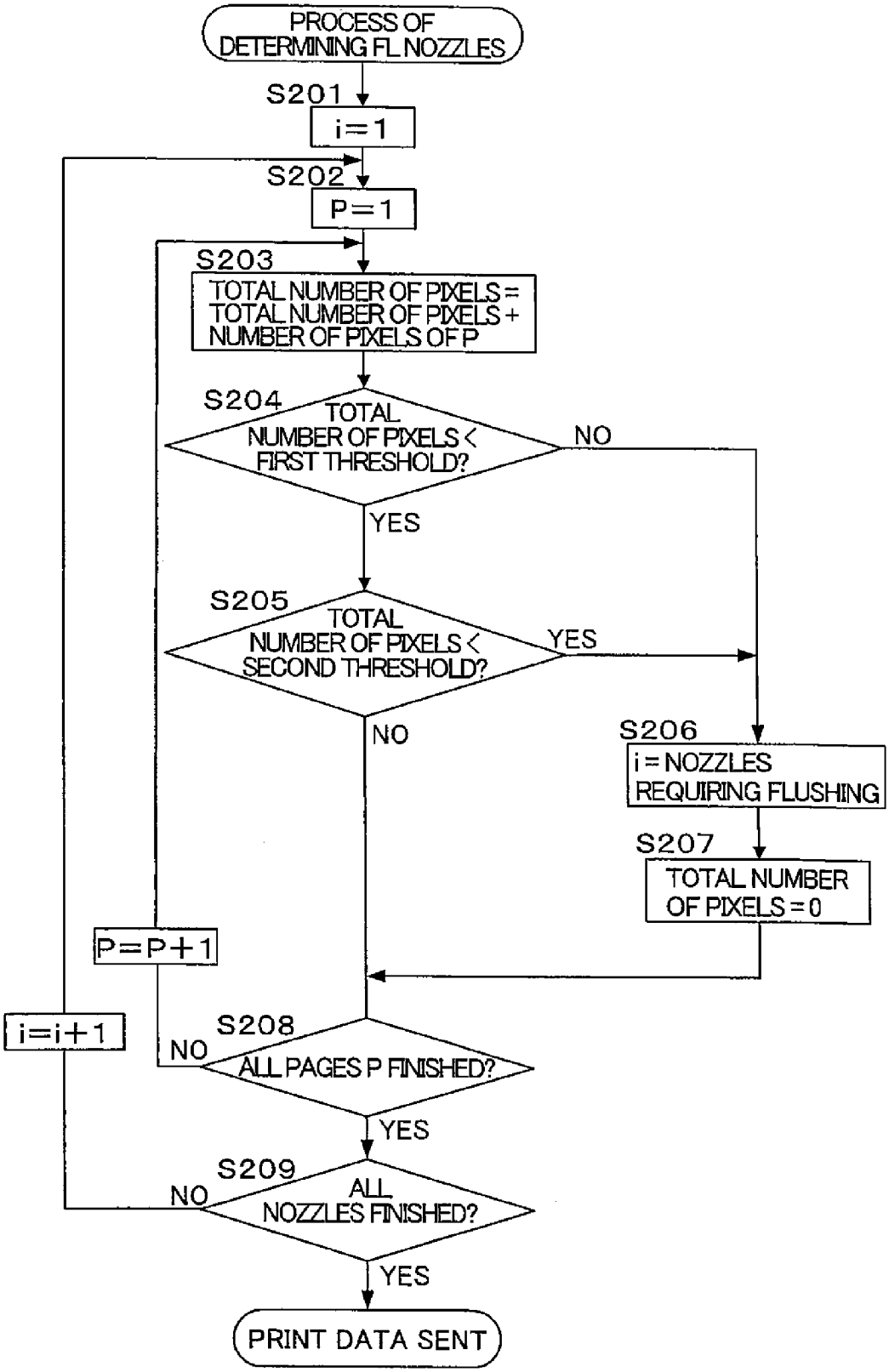
FIG. 11 is a flowchart in which the printer driver determines nozzles requiring flushing.

FIG. 11 is a flowchart in which the printer driver determines nozzles requiring flushing. For example, a check is performed as to whether or not flushing is required for each nozzle in order from nozzle #1 (i=1, S201). Then, a check is performed of the number of pixels associated with nozzle #1 for each page in order from page 1 (P+1, S202).

First, the printer driver calculates a total number of pixels (S203). "Total number of pixels" refers to a total sum of the number of pixels associated with nozzle #i in a period from when nozzle #i carried out a previous flushing until a page P. Thus, this is calculated by "total number of pixels=total number of pixels until previous page+number of pixels associated with nozzle #i at a page P (number of pixels of P)". For example, if the number of pixels associated with nozzle #1 at page 1 is 4,000 pixels, since page 1 is the first page, "total number of pixels=0+4,000=4,000".

Next, the printer driver compares (S204) the total number of pixels and a first threshold (=12,000, first predetermined number). If the total number of pixels is the first threshold or more (no), then nozzle #i is judged to be a nozzle requiring flushing (S206).

On the other hand, if the total number of pixels is smaller than the first threshold (yes), then next the printer driver checks a total number of ejections (S205). Here, "total number of ejections" is the number of dots to be formed by nozzle #i on page P. For example, suppose that the number of pixels in which dots are to be formed among the 4,000 pixels associated with nozzle #1 on page 1 is 1,000. Then the printer driver compares (S205) the total number of ejections (=1,000) and a second threshold (=800, second predetermined number). If the total number of ejections is the second threshold or more (no), then nozzle #i is not judged to be a nozzle requiring flushing on page P. And the printer driver checks (S208) whether or not nozzle #i requires flushing on the next page without resetting the value of the total number of pixels.

If the total number of ejections is smaller than the second threshold (yes), then nozzle #i is judged to be a nozzle requiring flushing on page P (S206). That is, in the case where the number of times of ejections of ink by nozzle #i on page P is less than the second threshold, there is a risk that a blockage will occur in nozzle #i. It should be noted that the number for the second threshold may be varied depending on the size of the medium to be printed.

FIG. 12 shows a flushing table. When nozzle #i is judged to be a nozzle requiring flushing on page P, the printer driver stores that information in the flushing table. For example, when nozzle #1 is judged to require flushing on page 3, "○" is recorded in the flushing table. A "x" is recorded in the flushing table for pages and nozzles other than where flushing is judged to be required.

After this, when nozzle #i is judged to be a nozzle requiring flushing on page P (S206), the count for the total number of pixels is reset to zero (S207). After this, if there is a next page, the printer driver checks (S208) whether or not nozzle #i requires flushing on the next page. Then, when all the pages are finished, the printer driver commences an operation of checking whether or not the next nozzle requires flushing (S209).

To describe the foregoing process more specifically, when the number of pixels associated with nozzle #i on page 1 is 4,000 pixels, the total number of pixels (4,000) is less than the first threshold (12,000), and therefore next, the total number of ejections, which is the number of dots to be formed by the nozzle #i on page 1, is compared with the second threshold. Then if the total number of ejections is the second threshold or more, the number of pixels (4,000) associated with nozzle #i on page 2 is added to the total number of pixels. Then, since the newly calculated total number of pixels (=4,000+4,000=8,000) is also smaller than the first threshold, next the total number of ejections, which is the number of dots to be formed by nozzle #i on page 2, is compared with the second threshold. Then if the total number of ejections is the second threshold or more, the number of pixels (4,000) associated with nozzle #i on page 3 is added to the total number of pixels. The newly calculated total number of pixels (=8,000+4,000=12,000) is equivalent to the first threshold, and therefore the printer driver judges that nozzle #i requires flushing on page 3. Then the value of the total number of pixels is reset to zero, and the total number of pixels is newly calculated from page 4. That is, nozzle #i is judged to require flushing when printing of page 1 through page 3 is finished since there is a risk of the nozzle becoming blocked regardless of the number of times of ejection of ink from nozzle #i. For this reason, even when a large amount of ink is ejected from the nozzle #i such that there is no risk of blockage, at page 3 nozzle #i is judged to require flushing. However, unlike the foregoing embodiment, it is not necessary for the printer driver to check whether or not each pixel is non-ejection pixel, and therefore in the second embodiment, the time for the process of generating print data becomes faster.

Furthermore, for example, if the total number of ejections, which is the number of dots to be formed by nozzle #i on page 1, is smaller than the second threshold, then there is a risk of blockage, and therefore the printer driver judges that the nozzle #i requires flushing on page 1. That is, when the number of dots to be formed (total number of ejections) by the nozzle #i on a single page is less than the second threshold, there is a risk of blockage even if the total number of pixels associated with nozzle #i is small, and therefore nozzle #i is judged as requiring flushing on page 1. For this reason, in the second embodiment, although whether or not flushing is required is judged roughly according to the total number of pixels assigned to nozzle #i, the number of dots to be formed (total number of ejections) by nozzle #i is also checked each page, and therefore nozzle blockages can be reliably avoided.

As described above, the flushing table (FIG. 12), which indicates for each nozzle and on each page whether or not flushing is required, is generated by the printer driver. And based on the flushing table, the printer driver performs the conversion to the final print data in which flushing operations are added to the intermediate print data.

In FIG. 12, nozzle #1 requires flushing on page 3 and page 5. Accordingly, flushing dots are formed by nozzle #1 in the images of page 3 and page 5. For this reason, the printer driver checks whether or not a large dot is to be formed in a pixel adjacent to pixels assigned to nozzle #1 on page 3. It should be noted that the method for determining pixels in which flushing dots are to be formed is the same as in the foregoing embodiment, and if there is no large dot to be formed in adjacent pixels, the flushing dot is formed next to a medium dot. And if there is neither a large dot nor a medium dot to be formed in the adjacent pixels, the flushing dot is formed in a border area, a pixel where a multitude of dots are to be formed nearby, or a pixel on the most upstream side.

In the second embodiment, there is no checking of the number of continuous non-ejection pixels by checking for a non-ejection pixel for each pixel as in the foregoing embodiment, and therefore the process for generating print data is easier and the processing time is shorter compared to the foregoing embodiment. However, there is a possibility that flushing will be performed on a nozzle not requiring flushing.

It should be noted that in order to avoid performing flushing on a nozzle not requiring flushing, it is also possible to accumulatively add the total number of ejections for each page and compare this against a new threshold. For example, in the case where the number of dots to be formed is the second threshold or more on each of page 1 and page 2, the total number of ejections for each page is added. Then, the total number of pixels is the first threshold or more on page 3 (S204). Here, in FIG. 11, nozzle #i is judged to require flushing on page 3 even though it formed dots continuously on page 1 and page 2, but when a combined value of the total number of ejections for each of page 1 and page 2 is compared against a new threshold and the combined value of the total numbers of ejections is greater than the threshold, nozzle #i may be judged not to require flushing on page 3. By doing this, it is possible to avoid performing flushing on a nozzle not requiring flushing. Note however that the processing becomes more complicated compared to FIG. 11.

Furthermore, at S205 in the flowchart of FIG. 11, the total number of ejections per page, with the number of dots to be formed by nozzle #i as the total number of ejections, is compared against the second threshold, but there is no limitation to this. For example, the total number of ejections may be the total sum of the number of dots to be formed by nozzle #i in a period from when the nozzle #1 carried out a previous flushing until the page P.

Third Embodiment

In the foregoing embodiment, in the case where non-ejection pixels are continuous among pixels associated with nozzle #i, a flushing dot is formed at a non-ejection pixel adjacent to a pixel in which a large dot is formed. Furthermore, in the foregoing embodiment, a flushing dot is formed next to a large dot to be formed by a nozzle different from nozzle #i. In contrast to this, in a third embodiment, a flushing dot is formed by nozzle #i in a non-ejection pixel (downstream side pixel) associated with nozzle #i and which is a pixel immediately before a pixel in which a large dot (or a medium dot) is to be formed by nozzle #i.

Figure 13:
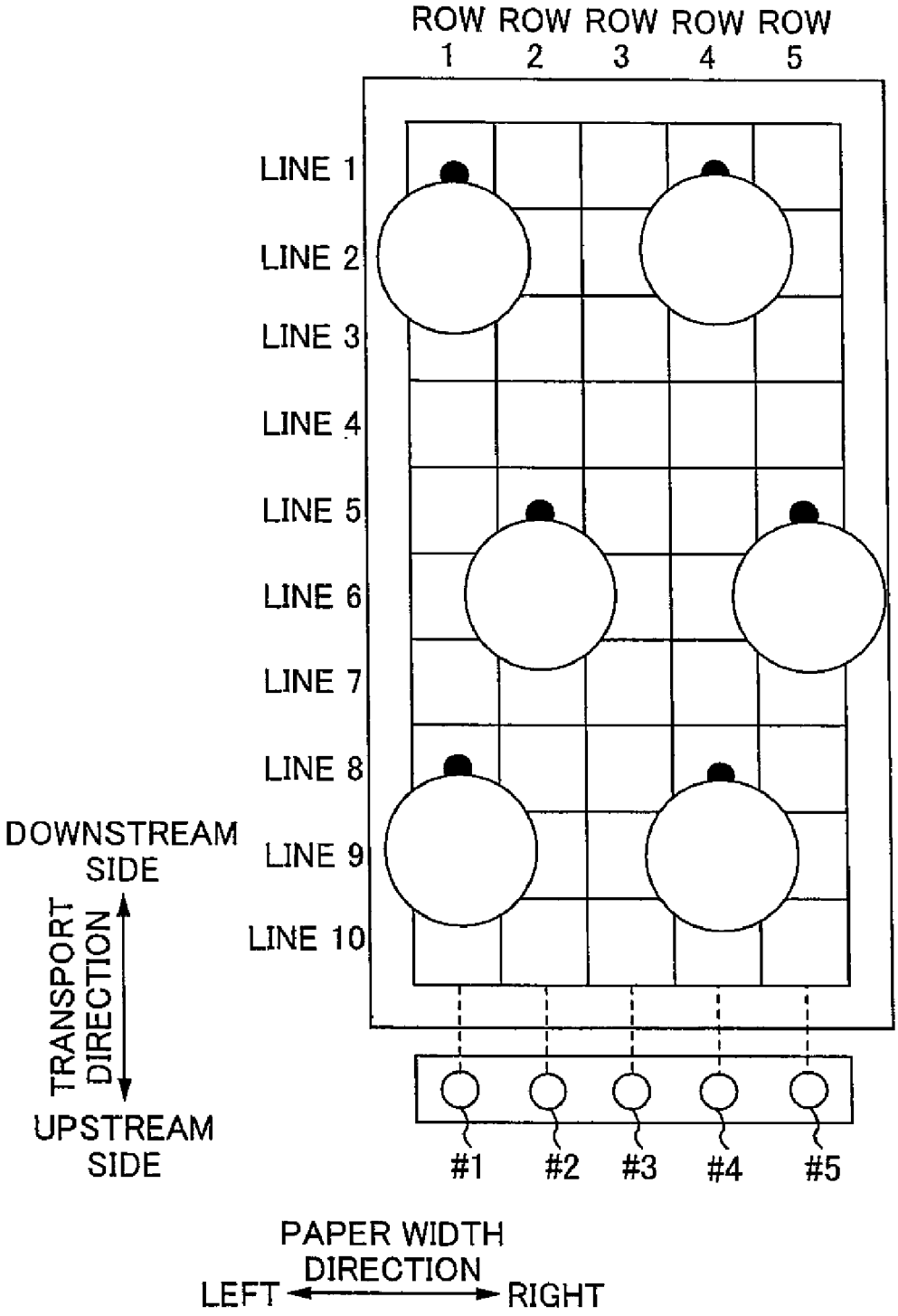
FIG. 13 shows a manner of forming flushing dots according to a third embodiment.

FIG. 13 shows a manner of forming flushing dots according to the third embodiment. Empty circles (○) in FIG. 13 indicate dots for image forming based on intermediate print data, and solid circles (●) in FIG. 13 indicate flushing dots unrelated to image forming. According to the intermediate print data, a large dot is to be formed in the pixel of row 2, line 6 associated with nozzle #2. If nozzle #2 becomes blocked before becoming in opposition to row 2, line 6, then a large dot will not be formed or the correct amount of ink will not be ejected such that the size of the large dot will become undesirably smaller. And when a large dot becomes a missing dot (which refers to dot not being formed in the location where the dot was intended to be formed), the effect on image deterioration tends to be greater than the effect by a medium dot or a small dot.

Accordingly, in the third embodiment, a flushing dot is formed by nozzle #i immediately before nozzle #i forms a large dot so that the large dot is formed reliably. That is, immediately before nozzle #i becomes in opposition to a pixel where a large dot is to be formed, nozzle #i forms a flushing dot in the pixel (downstream side pixel) opposing the nozzle #i. For example, in FIG. 13, a flushing dot is formed in the pixel of row 2, line 5, which is a pixel that the nozzle #2 opposes immediately before nozzle #2 opposes row 2, line 6.

By doing this, a large dot is formed reliably even if pixels before row 2, line 5 associated with nozzle #2 are continuous non-ejection pixels. Furthermore, since a flushing dot is formed in a pixel adjacent to a pixel in which a large dot is formed, the flushing dot is inconspicuous.

Furthermore, it is also possible to form a flushing dot by nozzle #i not only in a pixel where a large dot is to be formed, but also in a pixel on a downstream side of a pixel where a medium dot is to be formed by nozzle #i.

Other Embodiments

The foregoing embodiments gave description mainly regarding a printing system having an inkjet printer, and included disclosure of flushing methods during printing. Moreover, the foregoing embodiment is merely for facilitating the understanding of the invention, but is not meant to be interpreted in a manner limiting the scope of the invention. It goes without saying that the invention can be altered and improved without departing from the gist thereof and includes functional equivalents. In particular, embodiments described below are also included in the invention.

Regarding the Liquid Ejection Apparatus

In the foregoing embodiments, the printer driver in the computer 50 generated print data so as to form flushing dots, but the CPU 12 of the printer 1 may also serve the role of the printer driver. In this case, the printer 1 constitutes a liquid ejection apparatus by itself.

In the foregoing embodiments, an inkjet printer was shown as an example of (a portion of) a liquid ejection apparatus that executes a liquid ejection method, but there is no limitation to this. As long as it is a liquid ejection apparatus, the invention may be applied to various industrial apparatuses that are not printers (printing apparatuses). For example, the invention can also be applied to apparatuses such as a textile apparatus for applying a pattern to a fabric, a color filter manufacturing apparatus, an apparatus for manufacturing displays such as organic EL displays, a DNA chip manufacturing apparatus that manufactures a DNA chip by applying a solution in which DNA is dissolved onto a chip, and a circuit board manufacturing apparatus.

Furthermore, in the printer of the foregoing embodiments, a voltage was applied to a drive element (piezo element) to expand/contract an ink chamber in order to eject a liquid, but there is no limitation to this. For example, a printer may be used in which a bubble is produced inside the nozzle using a heating element and a liquid is ejected by that bubble.

Regarding Flushing

In the foregoing embodiments, capping was provided to seal the heads when printing, is not performed, but there is no limitation to this. For example, even without capping, if ink is ejected onto the printing paper during printing, no blockages of the nozzles occur. As a result, the structure of the printer can be simplified and miniaturization can be achieved. However, to restore the nozzles from an unoperated state, a contrivance is necessary involving ejecting ink to a border of the paper S at the commencement of printing.

Furthermore, in the foregoing embodiments, flushing using capping during printing was not carried out, but there is no limitation to this. For example, in the case where there is neither a large dot nor a medium dot to be formed in an adjacent pixel, flushing using capping may be carried out. As a result, it is not necessary to form flushing dots in such locations as the border or white spaces, and therefore an image having high image quality can be printed. Furthermore, it is possible to enable the user to select whether to print a high image quality image using capping during printing, or to not use capping during printing so as to print quickly.

In the foregoing embodiments, examples of capping put forth involved providing a cap in the non-print area (FIG. 5A) and providing holes in the belt (FIG. 5B), but there is no limitation to these. For example, a cap may be provided in a position opposing the transport belt and the head unit may be rotated.

Regarding Serial Printers

In the foregoing embodiments, description is given regarding methods of flushing during printing using a line head printer as an example, but there is no limitation to this. For example, a serial printer is also possible in which an image is formed by alternately repeating a transport operation of moving a paper in a transport direction and an operation (pass) in which dots are formed while a single head moves in a movement direction intersecting the transport direction.

Figure 14:
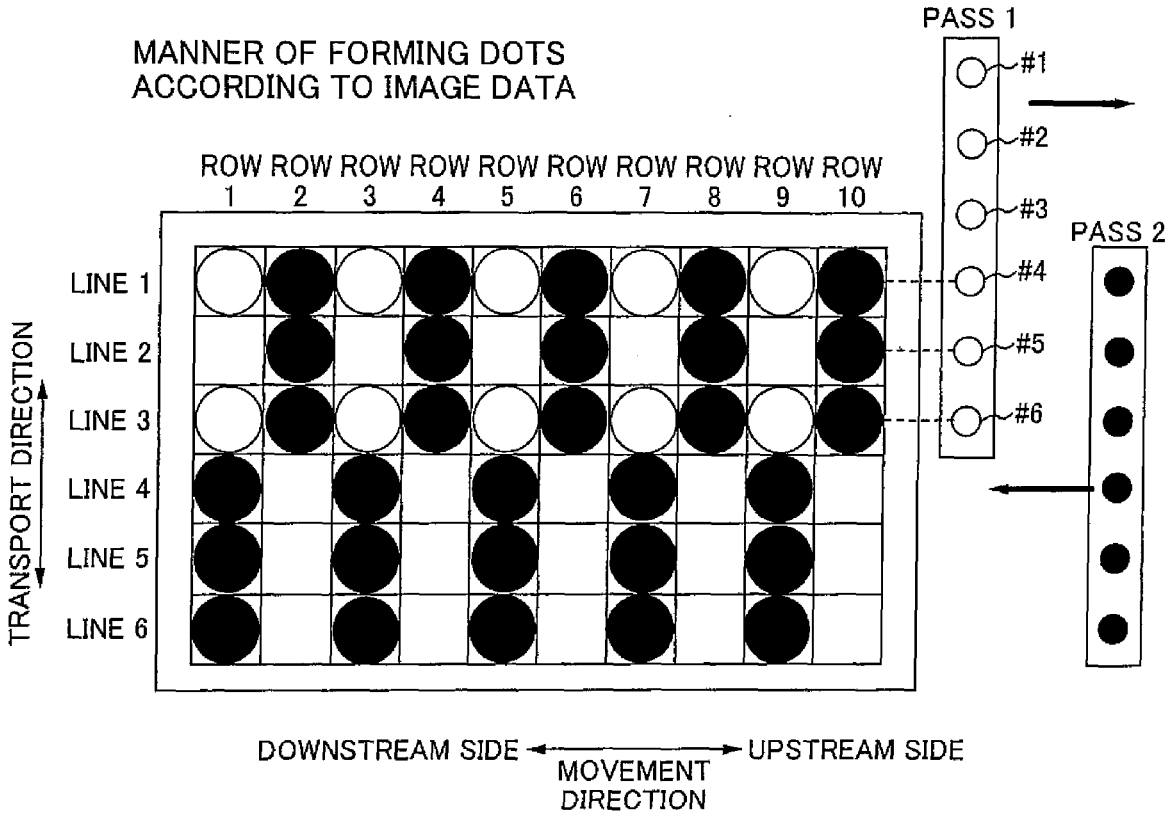
FIG. 14 is an explanatory diagram of overlap printing.

In the case of a serial printer, sometimes a printing method (overlap printing) is used in which a single raster line (dot row along the movement direction) is formed by a plurality of nozzles. FIG. 14 is an explanatory diagram of overlap printing. For example, in pass 1, dots are formed by nozzle #4 in odd numbered pixels (row 1, 3, 5 and so forth) of line 1, and in pass 2, dots are formed by nozzle #1 in even numbered pixels (row 2, 4, 6 and so forth) of line 1, thereby accomplishing a raster line in line 1.

For example, suppose a dot is not formed in an odd numbered row of line 2. In this case, nozzle #5, which is associated with the odd numbered rows in line 2, is at risk of becoming blocked, and therefore it is necessary to form a flushing dot in one of the odd numbered rows of line 2. That is, with the foregoing line head printer, flushing was carried out for a nozzle when there were five continuous pixels lined up in the transport direction (FIG. 7A), but with overlap printing using a serial printer, it is necessary to form flushing dots if pixels associated with each nozzle are continuous non-ejection pixels even if pixels lined up in the movement direction are not continuous non-ejection pixels.

That is, depending on the type of printer and the method of printing, it is necessary for the printer driver to check whether or not each pixel associated with each nozzle is a non-ejection pixel in the order in which the pixels associated with each nozzle pass under each nozzle rather than checking whether or not each data piece of pixels lined up in a fixed direction indicates a non-ejection pixel. Furthermore, depending on the type of printer and the method of printing, the positions of pixels adjacent to non-ejection pixels associated with pixels requiring flushing vary, but as long as a flushing dot is formed in a pixel adjacent to a pixel in which a large dot (medium dot) is to be formed, it is possible to avoid the flushing dots becoming undesirably conspicuous in the printed image.

What is claimed is:

1. A liquid ejection apparatus, comprising:

a nozzle row in which a plurality of nozzles that eject liquid toward a medium are arranged in a predetermined direction;

a moving mechanism that causes a relative movement between the medium and the nozzle row in an intersecting direction that intersects with the predetermined direction; and a control portion that causes the liquid to be ejected from the nozzle row based on an image data during the relative movement of the medium and the nozzle row in the intersecting direction, wherein the control portion determines:

according to image data, whether a pixel is an ejection pixel at which a liquid is to be ejected and a non-ejection pixel at which the liquid is not to be ejected;

according to the image data, a nozzle requiring flushing from among the plurality of nozzles; and from among ejection pixels that are adjacent to the at least one non-ejection pixel that is associated with the nozzle requiring flushing, the ejection pixel at which a largest size dot is to be formed, and wherein the control portion causes the nozzle requiring flushing to eject the liquid to the non-ejection pixel adjacent to the ejection pixel at which the largest size dot is to be formed and that is associated with the nozzle requiring flushing.

2. A liquid ejection apparatus according to claim 1, wherein the ejection pixel adjacent to the non-ejection pixel where the liquid is to be ejected from the nozzle requiring flushing is associated with the nozzle other than the nozzle requiring flushing.

3. A liquid ejection apparatus according to claim 1, wherein the nozzle requiring flushing ejects the liquid to the non-ejection pixel immediately before ejecting the liquid to the ejection pixel.

4. A liquid ejection apparatus according to claim 1, wherein the control portion determines a nozzle associated with a plurality of the non-ejection pixels that are continuous as the nozzle requiring flushing.

5. A liquid ejection apparatus according to claim 1, wherein the control portion calculates, based on the image data for each page, total number of pixels by summing a number of the pixels associated with each of the nozzles between a previous flushing and a certain page;

wherein the control portion determines, at a time the total number of pixels has reached a first predetermined number, the nozzle as the nozzle requiring flushing in the certain page; and wherein the control portion determines, in a case where the total number of pixels is less than the first predetermined number and, in the certain page, a number of the ejection pixels associated with the nozzle is less than a second predetermined number, the nozzle as the nozzle requiring flushing.

6. A liquid ejection apparatus according to claim 1, wherein a direction in which the ejection pixel at which a largest size dot is to be formed and the non-ejection pixel that is associated with the nozzle requiring flushing are adjacent to each other is the same as the predetermined direction.

7. A liquid ejection apparatus according to claim 3, wherein the control portion determines a nozzle associated with a plurality of the non-ejection pixels that are continuous as the nozzle requiring flushing.

8. A liquid ejection apparatus according to claim 7, wherein, wherein the control portion calculates, based on the image data for each page, total number of pixels by summing a number of the pixels associated with each of the nozzles between a previous flushing and a certain page;

wherein the control portion determines, at a time the total number of pixels has reached a first predetermined number, the nozzle as the nozzle requiring flushing in the certain page; and wherein the control portion determines, in a case where the total number of pixels is less than the first predetermined number and, in the certain page, a number of the ejection pixels associated with the nozzle is less than a second predetermined nozzle, the nozzle as the nozzle requiring flushing.

9. A liquid ejection apparatus according to claim 7, wherein a direction in which the ejection pixel at which a largest size dot is to be formed and the non-ejection pixel that is associated with the nozzle requiring flushing are adjacent to each other is the same as the predetermined direction.

10. A liquid ejection apparatus according to claim 8, wherein a direction in which the ejection pixel at which a largest size dot is to be formed and the non-ejection pixel that is associated with the nozzle requiring flushing are adjacent to each other is the same as the predetermined direction.

11. A liquid ejection method, comprising:

determining, according to image data, whether a pixel is an ejection pixel at which a liquid is to be ejected or a non-ejection pixel at which the liquid is not to be ejected;

determining, according to the image data, a nozzle requiring flushing in an array of nozzles in which a plurality of nozzles ejecting the liquid are arranged in a predetermined direction;

determining, from among ejection pixels that are adjacent to the non-ejection pixel that is associated with the nozzle requiring flushing, the ejection pixel at which a largest size dot is to be formed; and ejecting the liquid from the nozzle requiring flushing to the non-ejection pixel that is adjacent to the ejection pixel at which the largest size dot is to be formed and that is associated with the nozzle requiring flushing.

12. A liquid ejection method according to claim 11, wherein the ejection pixel adjacent to the non-ejection pixel where the liquid is to be ejected from the nozzle requiring flushing is associated with the nozzle other than the nozzle requiring flushing.

13. A liquid ejection method according to claim 11, wherein the liquid is ejected from the nozzle requiring flushing to the non-ejection pixel immediately before the nozzle requiring flushing ejects the liquid to the ejection pixel.

14. A liquid ejection method according to claim 11, wherein a nozzle associated with a plurality of the non-ejection pixels that are continuous is determined as the nozzle requiring flushing.

15. A liquid ejection method according to claim 11, wherein, based on the image data for each page, total number of pixels is calculated by summing a number of the pixels associated with each of the nozzles between a previous flushing and a certain page;

at a time the total number of pixels has reached a first predetermined number, the nozzle is determined as the nozzle requiring flushing in the certain page; and in a case where the total number of pixels is less than the first predetermined number and, in the certain page, a number of the ejection pixels associated with the nozzle is less than a second predetermined number, the nozzle is determined as the nozzle requiring flushing.

16. A liquid ejection method according to claim 11, wherein a direction in which the ejection pixel at which a largest size dot is to be formed and the non-ejection pixel that is associated with the nozzle requiring flushing are adjacent to each other is the same as the predetermined direction.

17. A liquid ejection method according to claim 13, wherein a nozzle associated with a plurality of the non-ejection pixels that are continuous is determined as the nozzle requiring flushing.

18. A liquid ejection method according to claim 17, wherein, based on the image data for each page, total number of pixels is calculated by summing a number of the pixels associated with each of the nozzles between a previous flushing and a certain page;

at a time the total number of pixels has reached a first predetermined number, the nozzle is determined as the nozzle requiring flushing in the certain page; and in a case where the total number of pixels is less than the first predetermined number and, in the certain page, a number of the ejection pixels associated with the nozzle is less than a second predetermined number, the nozzle is determined as the nozzle requiring flushing.

19. A liquid ejection method according to claim 17, wherein a direction in which the ejection pixel at which a largest size dot is to be formed and the non-ejection pixel that is associated with the nozzle requiring flushing are adjacent to each other is the same as the predetermined direction.

20. A liquid ejection method according to claim 1, wherein a direction in which the ejection pixel at which a largest size dot is to be formed and the non-ejection pixel that is associated with the nozzle requiring flushing are adjacent to each other is the same as the predetermined direction.

* * * * *